US008967778B2

(12) United States Patent
Nozawa et al.

(10) Patent No.: US 8,967,778 B2
(45) Date of Patent: Mar. 3, 2015

(54) CARTRIDGE

(71) Applicant: Seiko Epson Corporation, Tokyo (JP)

(72) Inventors: Izumi Nozawa, Nagano (JP); Tadahiro Mizutani, Nagano (JP); Hidetoshi Kodama, Nagano (JP); Hiroyuki Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/782,457

(22) Filed: Mar. 1, 2013

(65) Prior Publication Data

US 2013/0229469 A1 Sep. 5, 2013

(30) Foreign Application Priority Data

Mar. 2, 2012 (JP) ..... 2012-046947

(51) Int. Cl.
*B41J 2/175* (2006.01)

(52) U.S. Cl.
CPC ..... *B41J 2/17553* (2013.01); *B41J 2/1752* (2013.01)
USPC ..... 347/86

(58) Field of Classification Search
USPC ..... 347/86
See application file for complete search history.

(56) References Cited

U.S. PATENT DOCUMENTS

| | | | | |
|---|---|---|---|---|
| 5,583,549 | A * | 12/1996 | Ujita et al. | 347/86 |
| 6,045,207 | A * | 4/2000 | Mochizuki et al. | 347/7 |
| 2002/0060726 | A1* | 5/2002 | Udagawa et al. | 347/93 |
| 2004/0090503 | A1* | 5/2004 | Kotaki et al. | 347/86 |
| 2005/0151811 | A1 | 7/2005 | Shimizu et al. | |
| 2010/0192352 | A1* | 8/2010 | Pearson et al. | 29/428 |

FOREIGN PATENT DOCUMENTS

JP 2007-230249 A 9/2007

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

A cartridge includes a printing material supply port which is configured and arranged to be connected to a printing material supply pipe provided in a printing device. An effective area T of the printing material supply port is the same or more and five times or less than an effective area S of the printing material supply pipe. The effective area T may be set as two times or more and is 4.5 times or less than the effective area S. The effective area T may be set as three times or more and is four times or less than the effective area S.

6 Claims, 20 Drawing Sheets

CROSS SECTION F5—F5

CARTRIDGE

CROSS-REFERENCE TO RELATED APPLICATIONS

This application claims priority to Japanese Patent Application No. 2012-046947 filed on Mar. 2, 2012. The entire disclosure of Japanese Patent Application No. 2012-046947 is hereby incorporated herein by reference.

BACKGROUND

1. Technical Field

The present invention relates to a cartridge.

2. Related Art

As printing devices which eject a liquid such as an ink (a printing material) from a recording head toward a printing medium, ink jet printers are widely known.

The ink jet printers are provided with a carriage and a recording head which is mounted on the carriage. Printing is performed with regard to the printing medium by the ink being ejected from a nozzle which is formed in the printing head while the carriage moves so as to scan with regard to the printing medium.

Among ink jet printers, there is an ink jet printer where a cartridge which supplies ink to the recording head is mounted on the carriage (an on-carriage type). The cartridge is mounted with regard to the carriage to be able to be attached and detached.

In Japanese Laid-Open Patent Application Publication No. 2007-230249, a cartridge is disclosed where ink which is contained in the cartridge is supplied to a printer by a printing material supply port of the cartridge and a printing material supply pipe of the printer being connected.

SUMMARY

In recent years, there has been increasing demand for a printer with a faster printing speed. As a result, the capabilities of the recording head have improved but only this is not sufficient. Defects in printing are generated since the supply capabilities of the ink to the recording head are low even if the capabilities of the recording head have been improved and breakages due to empty discharging (empty ejection) are generated.

In order to realize high speed printing, it is necessary to also improve the supply capabilities of the printing material from the cartridge to the recording head.

The present invention has been carried out in consideration of the problems described above and has the object of providing a cartridge with a high capacity for supplying printing materials to a printer.

A cartridge according to one aspect is provided with a printing material supply port connected to a printing material supply pipe which is provided in a printing device where an effective area of the printing material supply port is the same or more and is five times or less than an effective area of the printing material supply pipe.

With the cartridge according to one aspect, the effective area of the printing material supply port is two times or more and is 4.5 times or less than the effective area of the printing material supply pipe.

With the cartridge according to one aspect, the effective area of the printing material supply port is three times or more and is four times or less than the effective area of the printing material supply pipe.

The cartridge according to one aspect has a first surface and a second surface which oppose each other, a third surface and a fourth surface which intersect with the second surface and the first surface and which oppose each other, and a fifth surface and a sixth surface which intersect with the first surface to the fourth surface and which oppose each other, where the printing material supply port is provided in the first surface, and, when a distance between the first surface and the second surface is height, a distance between the third surface and the fourth surface is depth, and a distance between the fifth surface and the sixth surface is width, the depth is larger than the height and the height is larger than the width, and effective dimension of the printing material supply port in the depth direction is the same or more and is five times or less than effective dimension of the printing material supply pipe in the depth direction.

The cartridge according to one aspect has a first surface and a second surface which oppose each other, a third surface and a fourth surface which intersect with the second surface and the first surface and which oppose each other, and a fifth surface and a sixth surface which intersect with the first surface to the fourth surface and which oppose each other, where the printing material supply port is provided in the first surface, and, when a distance between the first surface and the second surface is height, a distance between the third surface and the fourth surface is depth, and a distance between the fifth surface and the sixth surface is width, the depth is larger than the height, and the height is larger than the width, and effective dimension of the printing material supply port in the depth direction is 1.5 times or more and is four times or less than effective dimension of the printing material supply pipe in the depth direction.

The cartridge according to one aspect has a first surface and a second surface which oppose each other, a third surface and a fourth surface which intersect with the second surface and the first surface and which oppose each other, and a fifth surface and a sixth surface which intersect with the first surface to the fourth surface and which oppose each other, where the printing material supply port is provided in the first surface, and, when a distance between the first surface and the second surface is height, a distance between the third surface and the fourth surface is depth, and a distance between the fifth surface and the sixth surface is width, the depth is larger than the height, and the height is larger than the width, and effective dimension of the printing material supply port in the depth direction is two times or more and is three times or less than effective dimension of the printing material supply pipe in the depth direction.

With the cartridge according to one aspect, the effective areas of the printing material supply port and the printing material supply pipe are regulated using effective area of filters which are provided in the printing material supply port and the printing material supply pipe.

With the cartridge according to one aspect, the effective dimension of the printing material supply port and the printing material supply pipe in the depth direction are regulated using effective dimension in the depth direction of filters which are provided in the printing material supply port and the printing material supply pipe.

BRIEF DESCRIPTION OF THE DRAWINGS

Referring now to the attached drawings which form apart of this original disclosure.

DETAILED DESCRIPTION OF EXEMPLARY EMBODIMENTS

Below, a printing material supply system where the present invention has been applied will be described.

Overall Configuration of Printing Material Supply System

Figure 1:
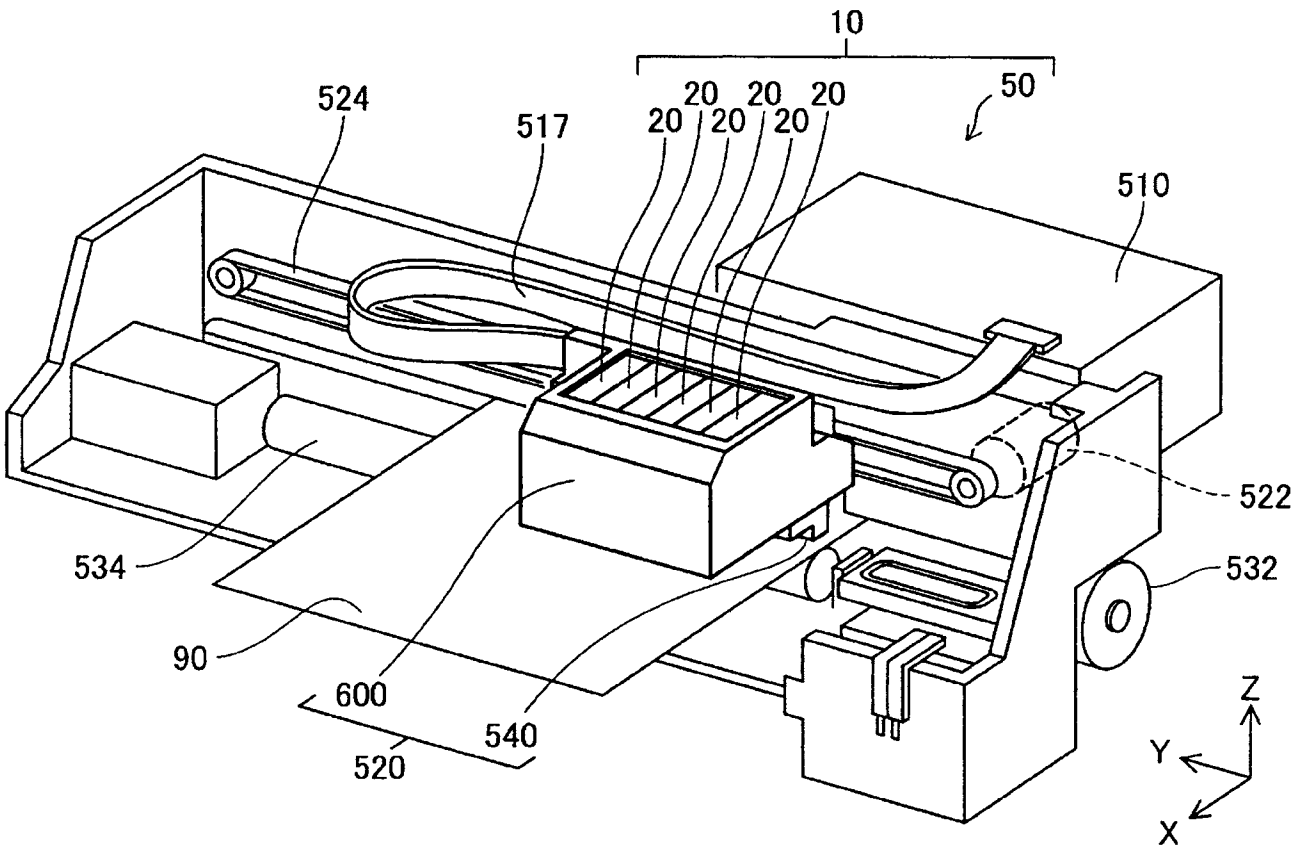
FIG. 1 is a perspective diagram illustrating a configuration of a printing material supply system.

FIG. 1 is a perspective diagram illustrating a configuration of a printing material supply system 10. X, Y, and Z axes are drawn to be orthogonal to each other in FIG. 1. The X, Y, and Z axes in FIG. 1 correspond to the X, Y, and Z axes in the other diagrams. In the embodiment, the Z axial direction is the vertical direction. The printing material supply system 10 is provided with a cartridge 20 and a printer (a printing device) 50. In the printing material supply system 10, the cartridge 20 is mounted to a holder (a cartridge mounting section) 600 of the printer 50 to be able to be attached and detached by a user.

The cartridge 20 of the printing material supply system 10 is a cartridge (an ink cartridge) which has a function of containing ink (a printing material) and is configured to be able to be attached and detached with regard to the printer 50. The ink as the printing material which is contained in the cartridge 20 is supplied to a head 540 of the printer 50 via a printing material supply port and a printing material supply pipe which will be described later. In the embodiment, a plurality of the cartridges 20 are mounted in the holder 600 of the printer 50 to be able to be attached and detached. In the embodiment, one of each of six types of cartridges 20, that is, a total of six of the cartridges 20 are mounted in the holder 600 to correspond to six colors of ink (black, yellow, magenta, light magenta, cyan, and light cyan).

The number of cartridges which are mounted in the holder 600 is not limited to six, it is possible to arbitrarily change the number to match the configuration of the printer 50, and there may be six or less or there may be six or more. The type of ink in the cartridges 20 is not limited to six colors and may be six or less colors (for example, the four colors of black, yellow, magenta, and cyan) or six or more colors (for example, a color configuration where specialized glossy colors (metallic gloss, pearl white, or the like) are added to the ink colors of the embodiment). In another embodiment, two or more of the cartridges 20 may be mounted in the holder 600 to correspond to one color of ink. The detailed configuration of the cartridge 20 and the holder 600 will be described later.

The printer 50 of the printing material supply system 10 is an ink jet printer which includes a printing device which has a function of supplying the ink (the printing material). Other than the holder 600, the printer 50 is provided with a control section 510, a carriage 520, and the head 540. The printer 50 has a function (the printing device) where the ink is supplied from the cartridge 20 which is mounted in the holder 600 to the head 540, and data such as text, a diagram, and an image is printed onto a printing medium 90 by the ink being discharged from the head 540 with regard to the printing medium 90 such as paper or a label.

The control section 510 of the printer 50 controls each section of the printer 50. The carriage 520 of the printer 50 is configured to be able to relatively move the head 540 with regard to the printing medium 90. The head 540 of the printer 50 is provided with an ink discharge mechanism which receives supply of the ink from the cartridge 20 which is mounted in the holder 600 and discharges the ink to the printing medium 90. The control section 510 and the carriage 520 are electrically connected via a flexible cable 517 and the ink discharge mechanism of the head 540 is operated based on a control signal from the control section 510.

In the embodiment, the head 540 is configured along with the holder 600 in the carriage 520. In this manner, the type of printer where the cartridge 20 is mounted in the holder 600 on the carriage 520 which moves the head 540 is referred to as an "on-carriage type".

In another embodiment, the holder 600 may be configured in a portion which is different to the carriage 520 and the ink from the cartridge 20 which is mounted in the holder 600 may be supplied to the head 540 of the carriage 520 via a flexible tube. Such a type of printer is referred to as an "off-carriage type".

In the embodiment, the printer 50 is provided with a main scanning and feeding mechanism and a sub scanning and feeding mechanism for realizing printing with regard to the printing medium 90 by relatively moving the carriage 520 and the printing medium 90. The main scanning and feeding mechanism of the printer 50 is provided with a carriage motor 522 and a driving belt 254, and the carriage 520 is moved so as to reciprocate in the main scanning direction by motive force from the carriage motor 522 being transferred to the carriage 520 via the driving belt 524. The sub scanning and feeding mechanism of the printer 50 is provided with a transport motor 532 and a platen 534, and the printing medium 90 is transported in the sub scanning direction which intersects with the main scanning direction by motive force from the transport motor 532 being transferred to the platen 534. The carriage motor 522 of the main scanning and feeding mechanism and the transport motor 532 of the sub scanning and feeding mechanism are operated based on control signals from the control section 510.

In the embodiment, in the usage state of the printing material supply system 10, an axis along the sub scanning direction where the printing medium 90 is transported is set as the X axis, an axis along the main scanning direction where the carriage 520 is moved so as to reciprocate is set as the Y axis, and an axis along the direction of gravity is set as the Z axis. The X axis, the Y axis, and the Z axis intersect each other. Here, the usage state of the printing material supply system 10 is a state of the printing material supply system 10 which is arranged on a horizontal surface, and in the embodiment, the horizontal surface is a surface which is parallel to the X axis and the Y axis.

In the embodiment, the +X axial direction is toward the sub scanning direction and the opposite is the −X axial direction, and the +Z axial direction is from below to above in the direction of gravity and the opposite is the −Z axial direction. In the embodiment, the +X axial direction side is the front surface of the printing material supply system 10. In the embodiment, the +Y axial direction is toward the left side surface from the right side surface of the printing material supply system 10 and the opposite is the −Y axial direction. In the embodiment, the alignment direction of the plurality of cartridges 20 which are mounted in the holder 600 is a direction along the Y axis.

Configuration where Cartridge is Mounted in Holder

Figure 2:
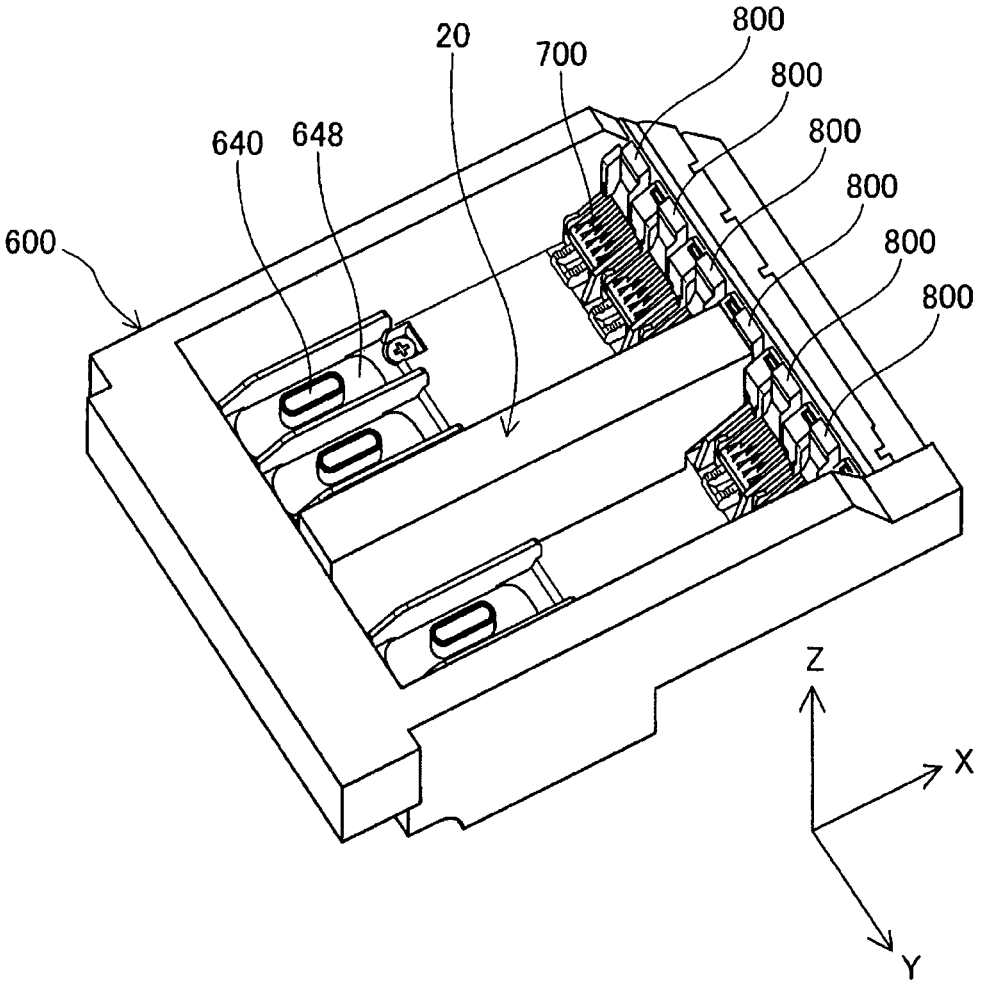
FIG. 2 is a perspective diagram illustrating a holder where a cartridge is mounted.
Figure 3:
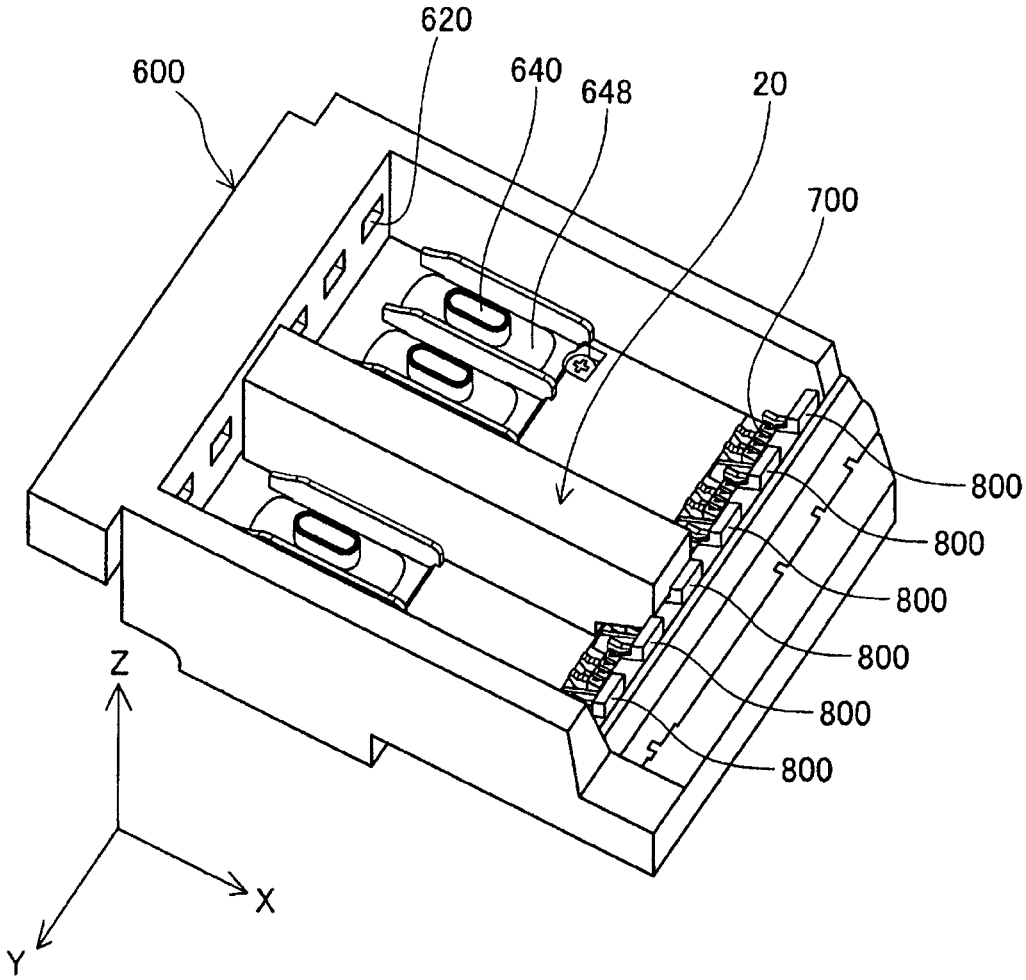
FIG. 3 is a perspective diagram illustrating a holder where a cartridge is mounted.
Figure 4:
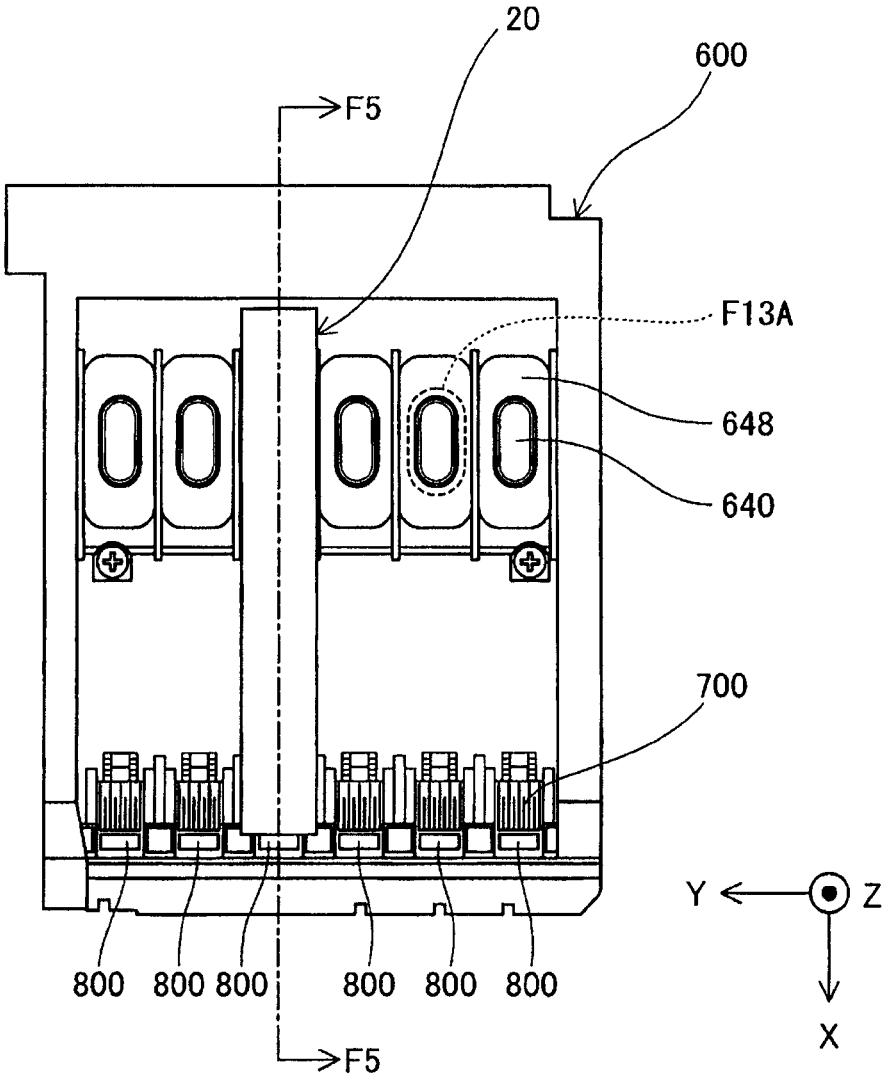
FIG. 4 is an upper surface diagram illustrating a holder where a cartridge is mounted.
Figure 5:
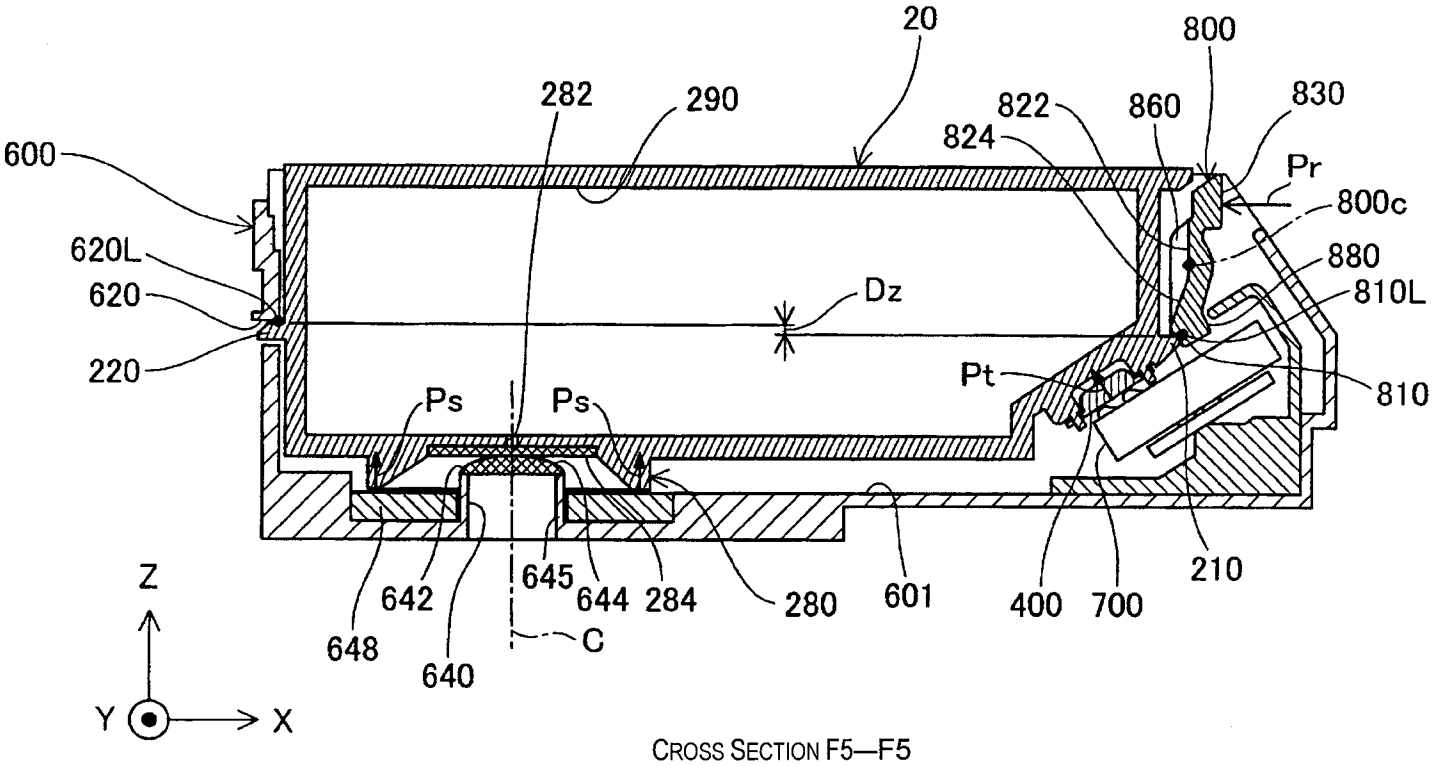
FIG. 5 is a cross-sectional diagram illustrating a cross section of a holder, where a cartridge is mounted, as taken along a section line F5-F5 in FIG. 4.

FIG. 2 and FIG. 3 are perspective diagrams illustrating the holder 600 where the cartridge 20 is mounted. FIG. 4 is an upper surface diagram illustrating the holder 600 where the cartridge 20 is mounted. FIG. 5 is a cross-sectional diagram illustrating a cross section of the holder 600 where the cartridge 20 is mounted, as taken along a section line F5-F5 in FIG. 4. A state is illustrated in FIG. 2 to FIG. 5 where one of the cartridges 20 is correctly mounted in a designed mounting position in the holder 600.

A plurality of slots (mounting spaces) which are able to receive the cartridges 20 are formed in the holder 600 of the printer 50 to correspond to each of the cartridges 20 so that the plurality of cartridges 20 are able to be mounted. The printer 50 is provided with an ink supply pipe (a printing material supply pipe) 640, a terminal platform 700, a lever 800, a first device side fastening section 810, and a second device side fastening section 620 in each of the slots in the holder 600.

As shown in FIG. 5, the cartridge 20 is provided with a first cartridge side fastening section 210, a second cartridge side fastening section 220, an ink containing section (a printing material containing section) 290, an ink supply port (a printing material supply port) 280, and a circuit substrate 400 to match with the slots which are formed in the holder 600 of the printer 50. In the embodiment, an ink flow path 282 is formed to be linked with the ink containing section 290 in the ink supply port 280 of the cartridge 20 and it is possible for the ink to be supplied from the ink containing section 290 to the outside of the cartridge 20 via the ink flow path 282. In the embodiment, a resin foam body 284, which prevents careless leaking of the ink from the ink flow path 282, is provided at an exit port side of the ink flow path 282.

The ink supply pipe 640 of the printer 50 is configured so that ink is able to be supplied from the ink containing section 290 of the cartridge 20 to the head 540 by being connected with the ink supply port 280 of the cartridge 20. The ink supply pipe 640 has a front end section 642 which is connected to the cartridge side. A base end section 645 of the ink supply pipe 640 is provided at the bottom surface of the holder 600. In the embodiment, as shown in FIG. 5, a central axis C of the ink supply pipe 640 is parallel to the Z axis and a direction, which is from the base end section 645 of the ink supply pipe 640 toward the front end section 642 along the central axis C, is the +Z axial direction.

In the embodiment, a porous filter 644 which filters the ink from the cartridge 20 is provided in the front end section 642 of the ink supply pipe 640. As the porous filter 644, for example, it is possible to use a stainless steel mesh, a stainless steel non-woven fabric, or the like. In another embodiment, the porous filter may be omitted from the front end section 642 of the ink supply pipe 640.

In the embodiment, an elastic member 648, which prevents leaking of the ink from the ink supply port 280 to the surroundings by tightly sealing the ink supply port 280 of the carriage 20, is provided in the surrounds of the ink supply pipe 640 as shown in FIG. 2 to FIG. 5. A pressing force Ps which includes components in the +Z axial direction is imparted from the elastic member 648 with regard to the ink supply port 280 in the cartridge 20 in a state of being mounted in the holder 600.

The terminal platform 700 of the printer 50 is provided more to a +X axial direction side than the ink supply pipe 640. Device side terminals are provided in the terminal platform 700 so as to be able to be electrically connected to cartridge side terminals which are provided in the circuit substrate 400 of the cartridge 20. A pressing force Pt which includes components in the +Z axial direction is imparted from the device side terminals which are provided in the terminal platform 700 with regard to the circuit substrate 400 in the cartridge 20 in a state of being mounted in the holder 600.

The first device side fastening section 810 in the printer 50 is provided as a portion of the lever 800 and fastens to the first cartridge side fastening section 210 at a first fastening position 810L. The first fastening position 810L is positioned more to the +Z axial direction side and the +X axial direction side than a position where the circuit substrate 400 and the device side terminals which are provided in the terminal platform 700 come into contact. The first device side fastening section 810 limits movement of the cartridge 20 in the +Z axial direction by fastening to the first cartridge side fastening section 210.

The second device side fastening section 620 in the printer 50 is provided as a portion of the holder 600 and is configured to be able to fasten to the second cartridge side fastening section 220 at a second fastening position 620L. In the embodiment, the second cartridge side fastening section 220 is fixed to the holder 600. The second fastening position 620L is positioned more to the +Z axial direction side and the −X axial direction side than the ink supply pipe 640. The second device side fastening section 620 limits movement of the cartridge 20 in the +Z axial direction by fastening to the second cartridge side fastening section 220.

Attaching and detaching of the cartridge 20 is performed while the cartridge 20 is rotated along a flat plane which is parallel to the Z axis and the X axis with the second cartridge side fastening section 220 and the second device side fastening section 620 which are engaged with each other as a rotation pivot during attaching and detaching of the cartridge 20 with regard to the holder 600. That is, the second cartridge side fastening section 220 and the second device side fastening section 620 function as the rotation pivot of the cartridge 20 during attaching and detaching of the cartridge 20. The details of the attaching and detaching operation of the cartridge 20 with regard to the holder 600 will be described later.

The lever 800 of the printer 50 has a rotation center 800*c* more to the +Z axial direction side and the +X axial direction side than the first fastening position 810L where the first device side fastening section 810 is fastened to the first cartridge side fastening section 210. There is a configuration so that fastening and releasing of the fastening to the first cartridge side fastening section 210 using the first device side fastening section 810 is possible due to the rotation of the lever 80 so that the first device side fastening section 810 moves from the first fastening location 810L in the +X axial direction.

An operation section 830, which is configured so that it is possible to receive an operation force Pr from the user toward the −X axial direction, is formed in the lever 800 more to the +Z axial direction side and the +X axial direction side than the rotation center 800*c*. When the operation force Pr is imparted to the operation section 830 by the user, the fastening of the first cartridge side fastening section 210 using the first device side fastening section 810 is released by the lever 800 being rotated so that the first device side fastening section 810 moves from the first fastening location 810L in the +X axial direction. Due to this, it is possible for the cartridge 20 to be removed from the holder 600.

As shown in FIG. 5, in a state where the cartridge 20 is mounted in the holder 600, the first fastening position 810L is positioned more to the −Z axial direction side than the second fastening position 620L with a distance Dz. As a result, the pressing forces Ps and Pt from the holder 600 with regard to the cartridge 20 act in a direction which strengthens the fastening of the first cartridge side fastening section 210 and the first device side fastening section 810 (a direction which includes +X axial components and +Z axial components) in a relationship of balancing the moment with the second fastening position 620L as the rotation pivot of the cartridge 20. Due to this, it is possible to stably maintain the cartridge 20 in the designed mounting position.

Detailed Configuration of Cartridge

Figure 6:
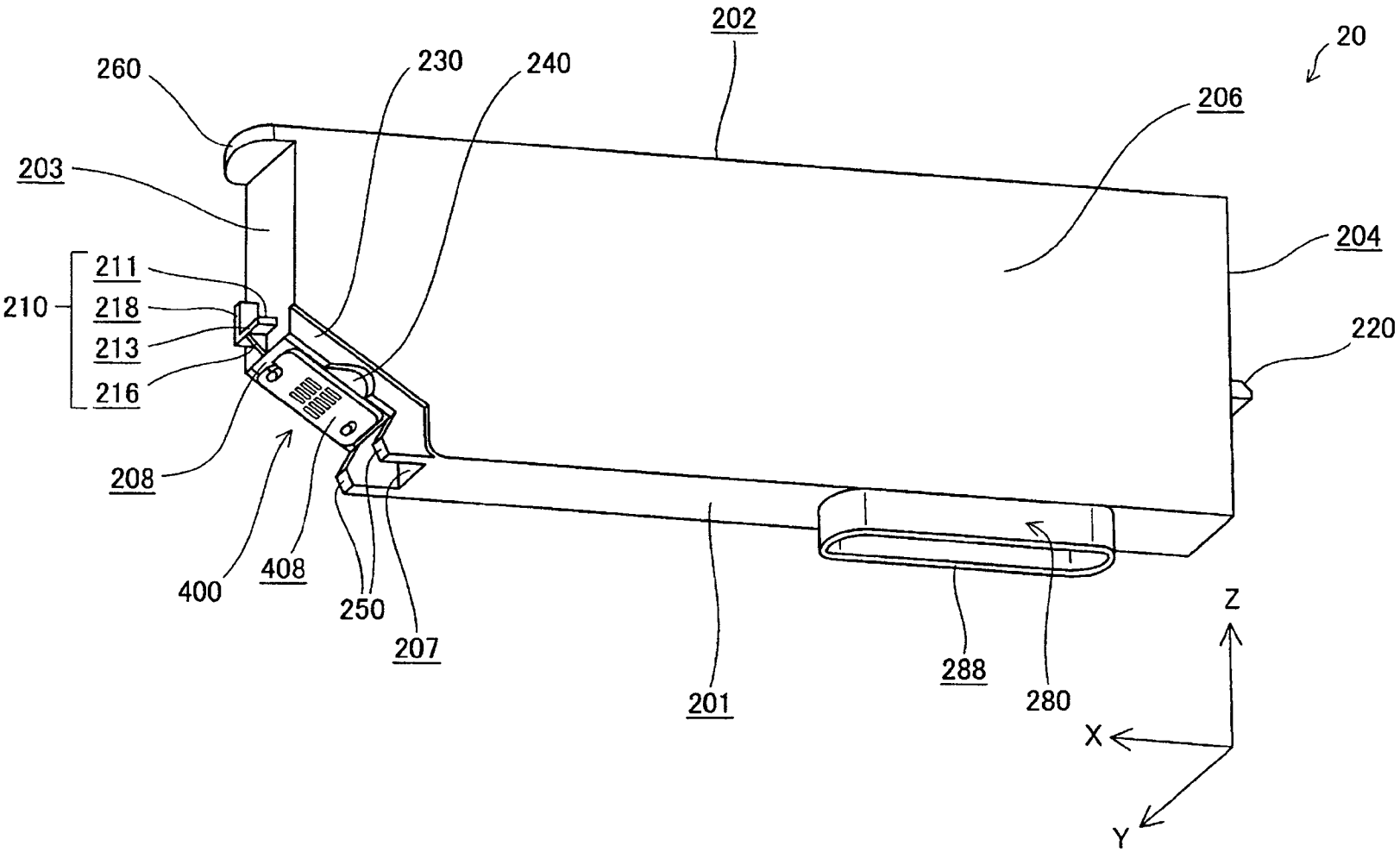
FIG. 6 is a perspective diagram illustrating a configuration of a cartridge.

FIG. 6 is a perspective diagram illustrating the configuration of the cartridge 20.

Figure 7:
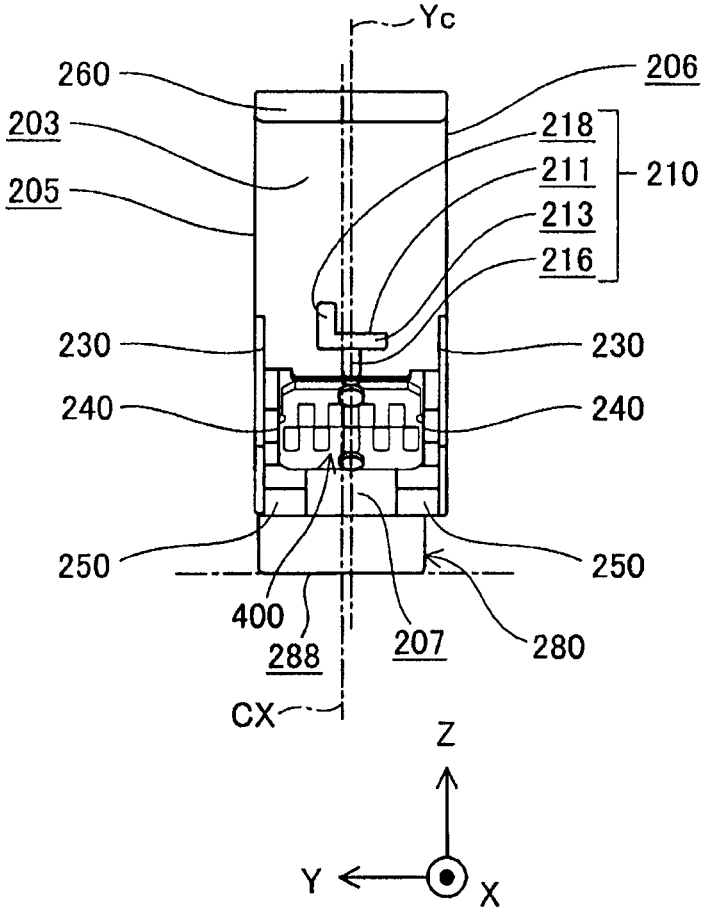
FIG. 7 is a front surface diagram illustrating a configuration of a cartridge.
Figure 8:
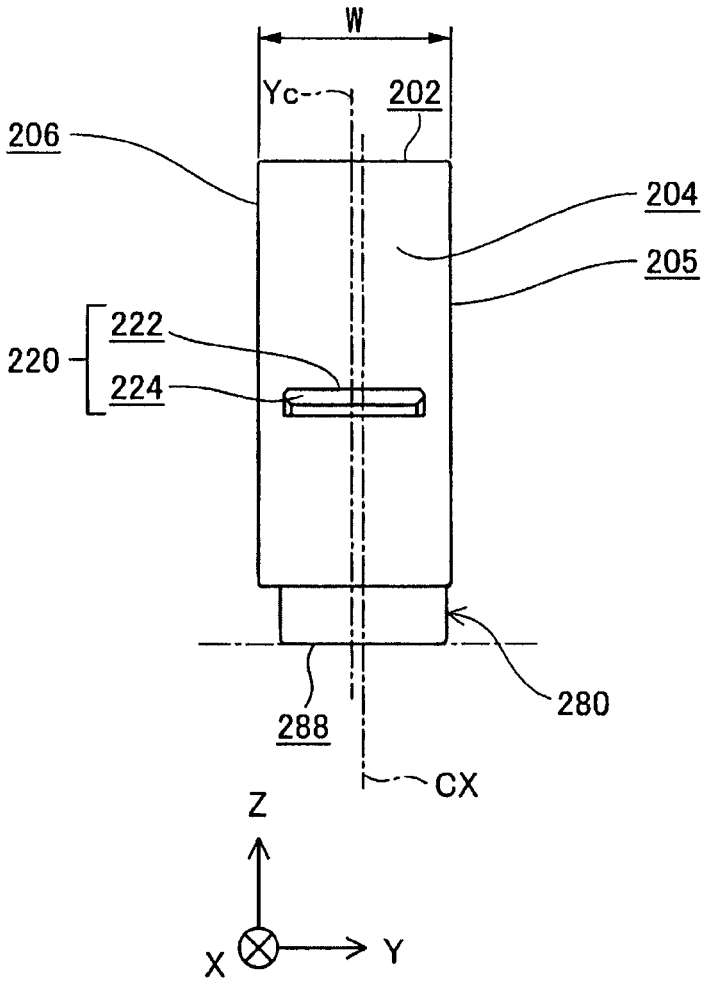
FIG. 8 is a rear surface diagram illustrating a configuration of a cartridge.
Figure 9:
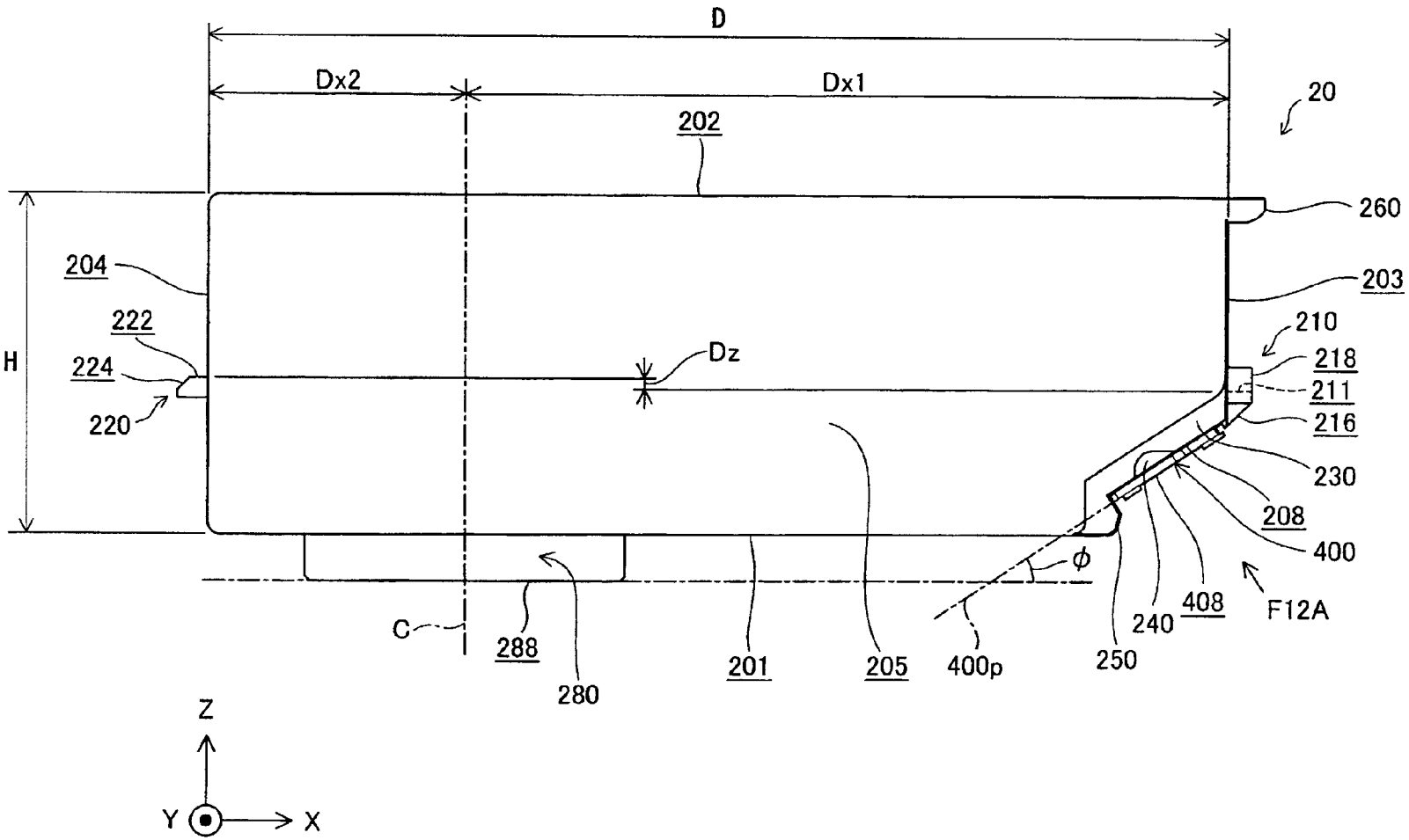
FIG. 9 is a left side surface diagram illustrating a configuration of a cartridge.
Figure 10:
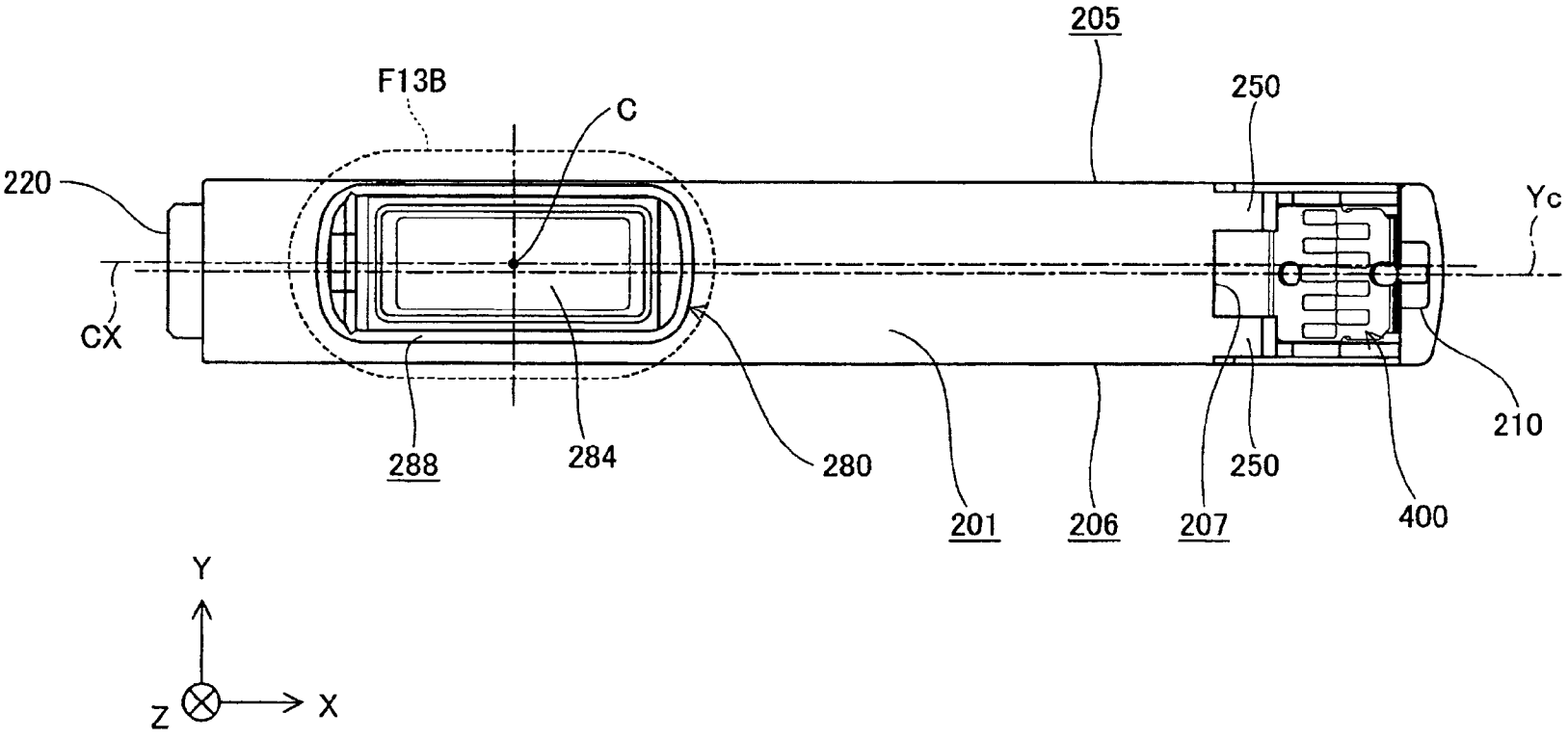
FIG. 10 is a bottom surface diagram illustrating a configuration of a cartridge.

FIG. 7 is a front surface diagram illustrating the configuration of the cartridge 20. FIG. 8 is a rear surface diagram illustrating the configuration of the cartridge 20. FIG. 9 is a left side surface diagram illustrating the configuration of the cartridge 20. FIG. 10 is a bottom surface diagram illustrating the configuration of the cartridge 20.

In the explanation of the cartridge 20, the X axis, the Y axis, and the Z axis are axes on the cartridge with regard to the cartridge 20 which is in the mounting state of being mounted in the holder 600. In the embodiment, the +X axial direction side is the front surface of the cartridge 20 in the mounting state where the cartridge 20 is mounted in the holder 600. A flat plane CX which is illustrated in FIG. 7, FIG. 8, and FIG. 10 is a flat plane which passes through the central axis C and which is parallel to the Z axis and the X axis. A flat plane Yc which is illustrated in FIG. 7, FIG. 8, and FIG. 10 is a flat plane which passes through the center of a length (width) in a direction along the Y axis of the cartridge 20 and which is parallel to the Z axis and the X axis.

As shown in FIG. 6 to FIG. 10, the cartridge 20 has a first surface 201, a second surface 202, a third surface 203, a fourth surface 204, a fifth surface 205, and a sixth section 206 as six flat planes which configure the outer shape with a regular solid as a base. In the embodiment, other than the first surface 201 to the sixth section 206 which correspond to the six flat planes of a rectangular solid, the cartridge 20 further has a seventh surface 207 and an eighth surface 208 between the first surface 201 and the third surface 203. The ink containing section 290 is formed at the inner side of the first surface 201 to the eighth surface 208.

The first surface 201 to the eighth surface 208 are formed substantially as flat planes, and it is not necessary for the entire area of the surface to be completely flat and there may be bumps on a portion of the surface. In the embodiment, the first surface 201 to the eighth surface 208 are the outer surfaces of an assembly which is assembled from a plurality of members. In the embodiment, the first surface 201 to the eighth surface 208 are formed by members a plate form. In another embodiment, a portion of the first surface 201 to the eighth surface 208 may be formed by members with a film form (thin film form). The first surface 201 to the eighth surface 208 are made of resin and are formed from a material (for example, polyacetal (POM)) where it is possible to obtain rigidity which is higher than polypropylene (PP) in the embodiment.

In the embodiment, a depth D (length in the X axial direction), a width W (length in the Y axial direction), and a height H (length in the Z axial direction) of the cartridge 20 are larger in the order of the depth D, the height H, and the width W.

That is, the depth D is larger than the height H and the height H is larger than the width W.

The first surface 201 and the second surface 202 of the cartridge 20 are surfaces which are parallel to the X axis and the Y axis and are in a positional relationship so as to oppose each other in the Z axial direction. The first surface 201 is positioned on the −Z axial direction side and the second surface 202 is positioned on the +Z axial direction side. The first surface 201 and the second surface 202 are in a positional relationship so as to intersect with the third surface 203, the fourth surface 204, the fifth surface 205, and the sixth surface 206.

Here, in the embodiment, the "intersecting" of two surfaces has the aim of any of the states of a state where two surfaces intersect by being linked to each other, a state where an extended surface of one of the surfaces intersects with the other surface, and a state where extended surfaces intersect with each other.

In the embodiment, the first surface 201 configured the bottom surface of the cartridge 20 and the second surface 202 configures the upper surface of the cartridge 20 in the mounting state where the cartridge 20 is mounted in the holder 600.

That is, the first surface 201 is referred to as the bottom surface, the second surface 202 is referred to as the upper surface, the third surface 203 is referred to as the front surface, the fourth surface 204 is referred to as the rear surface, the fifth surface 205 is referred to as the left side surface, and the sixth section 206 is referred to as the right side surface.

The ink supply port 280 is formed in the first surface 201. The ink supply port 280 protrudes from the first surface 201 in the −Z axial direction and an opening surface 288 is formed with an opening in a surface which is parallel to the X axis and the Z axis in an edge section in the −Z axial direction. In the embodiment, as shown in FIG. 10, the resin foam body 284 is provided in an inner side in the +Z axial direction side from the opening surface 288 at the inner side of the ink supply port 280. In the embodiment, the opening surface 288 of the ink supply port 280 is sealed by a sealing member (not shown) such as a cap or a film during shipping of the cartridge 20 from the factory, and after this, the sealing member (not shown)

which seals the opening surface 288 is removed from the cartridge 20 during mounting of the cartridge 20 with regard to the holder 600.

In the embodiment, the ink supply port 280 protrudes in the −Z axial direction with the central axis C of the ink supply pipe 640 as the center, but in another embodiment, the center of the ink supply port 280 may deviate from the central axis C of the ink supply pipe 640. In the embodiment, the opening surface 288 of the ink supply port 280 viewed from the −Z axial direction to the +Z axial direction has a line symmetrical contours with regard to axes which are respectively parallel the X axis and the Y axis. In another embodiment, there may be contours which are not line symmetrical. In the embodiment, the shape of the opening surface 288 viewed from the Z axial direction is a shape where the corners of a rectangle have been rounded, but in another embodiment, may be shapes such as a circle, an ellipse, an oval, a square, or a rectangle.

The third surface 203 and the fourth surface 204 of the cartridge 20 are surfaces which are parallel to the Y axis and the Z axis and are in a positional relationship so as to oppose each other in the X axial direction. The third surface 203 is positioned on the +X axial direction side and the fourth surface 204 is positioned on the −X axial direction side. The third surface 203 and the fourth surface 204 are in a positional relationship so as to intersect with the first surface 201, the second surface 202, the fifth surface 205, and the sixth surface 206. In the embodiment, the third surface 203 configures the front surface of the cartridge 20 and the fourth surface 204 configures the rear surface of the cartridge 20 in the mounting state where the cartridge 20 is mounted in the holder 600.

The first cartridge side fastening section 210 is formed in the third surface 203. The first cartridge side fastening section 210 is provided more to the +Z axial direction side and the +X axial direction side than the ink supply port 280 and the circuit substrate 400. The first cartridge side fastening section 210 has a first fastening surface 211 which faces the +Z axial direction and is configured to be able to limit movement of the cartridge 20 in the +Z axial direction by the first device side fastening section 810 which is positioned at the first fastening location 810L being fastened to the first fastening surface 211 due to the rotation of the lever 800.

In the embodiment, the first cartridge side fastening section 210 is a convex section which protrudes from the third surface 203 in the +X axial direction. Due to this, it is possible to easily form the first cartridge side fastening section 210 in the third surface 203. In addition, it is possible for the user to easily confirm the first cartridge side fastening section 210 during mounting of the cartridge 20.

In the embodiment, as shown in FIG. 6, FIG. 7, and FIG. 9, the first cartridge side fastening section 210 is a convex section which protrudes from the third surface 203 in the shape of a letter L where the two sides are respectively parallel to the Y axis and the Z axis, and a wall section with a triangular shape viewed from a direction along the Y axis is formed from an edge section of the +X axial direction side of the L-shaped convex section toward the third surface 203 at the −Z axial direction side from the center in the Y axial direction of a portion which is parallel to the Y axis in the L-shaped convex section.

In the embodiment, the first cartridge side fastening section 210 has a third fastening surface 213 which faces the +X axial direction in addition to the first fastening surface 211 which faces the +Z axial direction, and is configured to be able to limit movement of the cartridge 20 in the +Z axial direction and the +X axial direction by the first device side fastening section 810 which is positioned at the first fastening location 810L being fastened to the first fastening surface 211 and the third fastening surface 213 due to the rotation of the lever 800. Due to this, it is possible to maintain the cartridge 20 in a more stable state in the designed mounting position.

In the embodiment, the first fastening surface 211 of the first cartridge side fastening section 210 is formed as a flat plane which faces the +Z axial direction to configure a portion which is parallel to the Y axis in the L-shaped convex section. That is, the first fastening surface 211 is a flat plane which is parallel to the X axis and the Y axis. In the embodiment, the third fastening surface 213 of the first cartridge side fastening section 210 is formed as a flat plane which faces the +X axial direction to configure a portion which is parallel to the Y axis in the L-shaped convex section. That is, the third fastening surface 213 is a flat plane which is parallel to the Y axis and the Z axis.

In the embodiment, the first cartridge side fastening section 210 has an inclined surface 216 which is inclined toward the −Z axial direction and the +X axial direction. The +Z axial direction side of the inclined surface 216 is adjacent to the −Z axial direction side of the third fastening surface 213 which is adjacent to the +X axial direction side of the first fastening surface 211 and the −Z axial direction side of the inclined surface 216 is adjacent to a portion which is adjacent to the third surface 203 and the eighth surface 208. Due to this, it is possible to smoothly guide the first device side fastening section 810 to the first fastening surface 211 when the cartridge 20 is mounted in the holder 600. In the embodiment, the inclined surface 216 of the first cartridge side fastening section 210 is formed as a flat plane in the +X axial direction side which configures the triangular wall section which is formed in the −Z axial direction side of the L-shaped convex section.

In the embodiment, the first cartridge side fastening section 210 has an extended surface 218 which extends a portion of the third fastening surface 213, which is adjacent to the +X axial direction side of the first fastening section 211, in the +Z axial direction. Due to this, it is possible to prevent the lever 800 from being lifted to the +Z axial direction side of the first fastening surface 211 when the cartridge 20 is mounted in the holder 600. In the embodiment, the extended surface 218 of the of the first cartridge side fastening section 210 is formed as a flat plane which faces the +X axial direction to configure a portion which is parallel to the Z axis in the L-shaped convex section. That is, the extended surface 218 is a flat plane which is parallel to the Y axis and the Z axis.

In the embodiment, a protruding section 260 is formed in the third surface 203. The protruding section 260 has a shape which extends the second surface 202 in the +X axial direction and protrudes from the third surface 203 in the +X axial direction. Since the protruding section 260 is formed in the cartridge 20, it is possible for the user to easily perform lifting of the cartridge 20 to the +Z axial direction side with the second cartridge side fastening section 220 as a rotation pivot by hooking a finger, which presses the operation section 830 of the lever 800 toward the −X axial direction side, on the protruding section 260 as it is when the cartridge 20 is removed from the holder 600. In another embodiment, the protruding section 260 may be omitted from the third surface 203.

The second cartridge side fastening section 220 is formed in the fourth surface 204. The second cartridge side fastening section 220 is provided more to the +Z axial direction side and the −X axial direction side than the ink supply port 280 and the circuit substrate 400. The second cartridge side fastening section 220 has a second fastening surface 222 which faces the +Z axial direction side, and is configured to be able to limit movement of the cartridge 20 in the +Z axial direction by fastening the second device side fastening section 620 to the second fastening surface 222.

In the embodiment, the second cartridge side fastening section 220 is configured so as to function as a rotation pivot of the cartridge 20 with regard to the holder 600 by engaging with the second device side fastening section 620 when attaching and detaching the cartridge 20 with regard to the holder 600. Due to this, it is possible to easily perform attaching and detaching of the cartridge 20 with regard to the holder 600.

In the embodiment, the second cartridge side fastening section 220 is a convex section which protrudes from the fourth surface 204 in the −X axial direction. Due to this, it is possible to easily form the second cartridge side fastening section 220 in the fourth surface 204. In addition, it is possible for the user to easily confirm the second cartridge side fastening section 220 during mounting of the cartridge 20.

In the embodiment, the second fastening surface 222 of the second cartridge side fastening section 220 is formed as a flat plane which faces the +Z axial direction to configure the convex section which protrudes from the fourth surface 204 in the −X axial direction. That is, the second fastening surface 222 is a flat plane which is parallel to the X axis and the Y axis.

In the embodiment, the second cartridge side fastening section 220 has an inclined surface 224 which is adjacent to the −X axial direction side of the second fastening surface 22 and the inclined surface 224 is inclined toward the +Z axial direction and the −X axial direction. Due to this, it is possible to smoothly guide the second fastening surface 222 to the second device side fastening section 620 when the cartridge 20 is mounted in the holder 600. In another embodiment, the inclined surface 224 may be omitted.

As shown in FIG. 9, the first fastening surface 211 of the first cartridge side fastening section 210 is provided more to the −Z axial direction side than the second fastening surface 222 of the second cartridge side fastening section 220, that is, in the first surface 201 side, with a distance Dz. In other words, the second fastening surface 222 is provided more to the +Z axial direction side than the first fastening surface 211, that is, the second surface 202 side, with the distance Dz. Due to this, it is possible to strongly fasten the first cartridge side fastening section 210 and the first device side fastening section 810 in the mounting state where the cartridge 20 is mounted in the holder 600.

In the embodiment, as shown in FIG. 7, FIG. 8, and FIG. 10, the first fastening surface 211 of the first cartridge side fastening section 210 and the second fastening surface 222 of the second cartridge side fastening section 220 are provided in positions which cut across the flat plane Yc which passes through the center of the width of the cartridge 20 (the length in the Y axial direction). Due to this, it is possible to suppress an action where the pressing forces Ps and Pt from the holder 600 with regard to the cartridge 20 work as forces which incline the cartridge 20 in the Y axial direction.

In the embodiment, as shown in FIG. 7, FIG. 8, and FIG. 10, the first fastening surface 211 of the first cartridge side fastening section 210 and the second fastening surface 222 of the second cartridge side fastening section 220 are provided in positions which cut across the flat plane CX which passes through the central axis C. Due to this, it is possible to efficiently suppress an action where the pressing force Ps from the holder 600 with regard to the cartridge 20 works as a force which inclines the cartridge 20 in the Y axial direction.

In the embodiment, as shown in FIG. 9, a distance Dx1 between the central axis C and the third surface 203 on the X axis is longer than a distance Dx2 between the central axis C and the fourth surface 204 on the X axis. That is, in terms of the distance on the X axis with regard to the ink supply port 280, the second fastening surface 222 of the second cartridge side fastening section 220 is closer than the first fastening surface 211 of the first cartridge side fastening section 210. Due to this, since the ink supply port 280 is formed at the second fastening surface 222 side which is positioned in front of the first fastening surface 211 with regard to the holder 600, it is possible to easily perform positioning of the cartridge 20 with regard to the holder 600.

In the embodiment, as shown in FIG. 10, the length in the Y axial direction of the first cartridge side fastening section 210 is smaller than the length in the Y axial direction of the second cartridge side fastening section 220. In the embodiment, the length in the Y axial direction of the first cartridge side fastening section 210 is also smaller than the length in the Y axial direction of the circuit substrate 400. In the embodiment, the length in the Y axial direction of the second cartridge side fastening section 220 is substantially the same as the length in the Y axial direction of the circuit substrate 400.

The fifth surface 205 and the sixth surface 206 of the cartridge 20 are surfaces which are parallel to the Z axis and the X axis and are in a positional relationship so as to oppose each other in the Y axial direction. The fifth surface 205 is positioned on the +Y axial direction side and the sixth surface 206 is positioned on the −Y axial direction side. The fifth surface 205 and the sixth surface 206 are in a positional relationship so as to intersect with the first surface 201, the second surface 202, the third surface 203, and the fourth surface 204. In the embodiment, the fifth surface 205 configures the left side surface of the cartridge 20 and the sixth surface 206 configures the right side surface of the cartridge 20 in the mounting state where the cartridge 20 is mounted in the holder 600.

The seventh surface 207 of the cartridge 20 is provided in a corner portion which connects the first surface 201 and the third surface 203 and is a surface which is formed so as to extend from the first surface 201 to the +Z axial direction. The seventh surface 207 is connected to the eighth surface 208 at the +Z axial direction side and is connected to the first surface 201 at the −Z axial direction side. In the embodiment, the seventh surface 207 is a surface which is parallel to the Y axis and the Z axis and is in a positional relationship which opposes the fourth surface 204.

The eighth surface 208 of the cartridge 20 is provided in a corner portion which connects the first surface 201 and the third surface 203 and is a surface which is formed more to the +Z axial direction than the seventh surface 207. The eighth surface 208 is connected to the third surface 203 at the +Z axial direction side and is connected to the seventh surface 207 at the −Z axial direction side. In the embodiment, the eighth surface 208 is inclined toward the −Z axial direction and the +X axial direction as shown in FIG. 6 and FIG. 9.

The circuit substrate 400 is disposed in the eighth surface 208 in the embodiment. As shown in FIG. 9, the circuit substrate 400 has a surface (referred to as "cartridge side inclined surface") 480 which is inclined towards the −Z axial direction and the +X axial direction in a state of being arranged in the eighth surface 208. The cartridge side terminals which are provided in the circuit substrate 400 of the cartridge 20 comes into contact with the device side terminals which are provided in the terminal platform 700 of the holder 600 at the cartridge side inclined surface 480 side in a state where the cartridge 20 is mounted in the holder 600.

It is preferable that an angle $\phi$ where the cartridge side inclined surface 408 is inclined with regard to a flat plane which is parallel to the X axis and the Y axis (the opening surface 288 of the ink supply port 280) to 25° to 40°. By the angle of the cartridge side inclined surface 480 being 25° or more, it is possible to secure a sufficient wiping amount. Wiping is scrapping of the cartridge side terminals which are provided in the cartridge side inclined surface 480 using the device side terminals which are provided in the terminal platform 700 when the cartridge 20 is mounted in the holder 600. Then, the wiping amount is a length where it is possible for the cartridge side terminals to scrap the device side terminals. Due to the wiping, it is possible to remove dust and dirt which has become attached onto the cartridge side terminals and reduce connection defects between the cartridge side terminals and the device side terminals. By the angle of the cartridge side inclined surface 480 being 40° C. or less, it is possible to secure sufficient components in the +Z axial direction which are included in the pressing force Pt with regard to the circuit substrate 400 from the device side terminals which are provided in the terminal platform 700.

In the embodiment, a pair of first engaging surfaces 230, a pair of second engaging surfaces 240, and a pair of protruding sections 250 are formed in the vicinity of the circuit substrate 400 in the cartridge 20 in order to prevent positional deviation of the cartridge side terminals which are provided in the circuit substrate 400 with regard to the device side terminals which are provided in the terminal platform 700 when the cartridge 20 is mounted in the holder 600.

The pair of first engaging surfaces 230, which are provided in positions in the fifth surface 205 and the sixth surface 206 of the cartridge 20 near the circuit substrate 400, are a pair of surfaces which are respectively parallel in the Z axis and the X axis, and are respectively provided on both sides in a direction along the Y axis in the circuit substrate 400. The pair of first engaging surfaces 230 are configured to be able to engage with a first engaging section (not shown) which is provided in the holder 600. Due to this, it is possible to prevent positional deviation of the circuit substrate 400 in the Y axial direction with regard to the holder 600 and it is possible for the cartridge side terminals to come into contact with regard to the device side terminals at a correct position.

In the embodiment, the pair of first engaging surfaces 230 has a surface on the fifth surface 205 side and a surface on the sixth surface 206 side. The surface on the fifth surface 205 side is a surface which spans from an area with a certain distance from the eighth surface 208 to the protruding sections 250 and which is lower than the fifth surface 205 in the −Y axial direction. The surface on the sixth surface 206 side is a surface which spans from an area with a certain distance from the eighth surface 208 to the protruding sections 250 and which is lower than the sixth surface 260 in the +Y axial direction. A distance between the pair of first engaging sections 230 along the Y axial direction is the dimension (width) of the cartridge 20 in the Y axial direction, that is, is smaller than a distance between the fifth surface 205 and the sixth surface 206 and is larger than the dimension (width) of the circuit substrate 400 in the Y axial direction.

The pair of second engaging surfaces 240, which are provided in a position in the fifth surface 205 and the sixth surface of the cartridge 20 near the circuit substrate 400, are a pair of surfaces which are respectively parallel in the Z axis and the X axis and are each provided on both sides in a direction along the Y axis in the circuit substrate 400. The pair of second engaging surfaces 240 are configured to be able to engage with a second engaging section (not shown) which is provided in the holder 600. Due to this, it is possible to prevent positional deviation of the circuit substrate 400 in the Y axial direction with regard to the holder 600 and it is possible for the cartridge side terminals to come into contact with regard to the device side terminals at a correct position.

In the embodiment, the pair of second engaging surfaces 240 has a surface on the fifth surface 205 side and a surface on the sixth surface 206 side. The surface on the fifth surface 205 side is a surface which is even lower in the −Y axial direction than a portion, which is adjacent to the eighth surface 208, in the first engaging surfaces 230. The surface on the sixth surface 206 side is a surface which is even lower in the +Y axial direction than a portion, which is adjacent to the eighth surface 208, in the first engaging surfaces 230 which is lower than the sixth surface 206 in the +Y axial direction. A distance between the pair of second engaging surfaces 240 along the Y axial direction is the dimension (width) of the cartridge 20 in the Y axial direction, that is, is smaller than a distance between the fifth surface 205 and the sixth surface 206 and is substantially the same as the dimension (width) of the circuit substrate 400 in the Y axial direction.

The pair of protruding sections 250 in the cartridge 20 respectively protrude to side portions of the seventh surface 207 in the +Y axial direction and the −Y axial direction and toward the +X axial direction. The pair of protruding sections 250 are branched away from each other in the Y axis more to the −Z axial direction side than the circuit substrate 400. The pair of protruding section 250 are configured to be able to engage with an interlocking section (not shown) which is provided in the holder 600. Due to this, it is possible to prevent positional deviation of the circuit substrate 400 in the Y axial direction with regard to the holder 600 and it is possible for the cartridge side terminals to come into contact with regard to the device side terminals at a correct position.

Figure 11A:
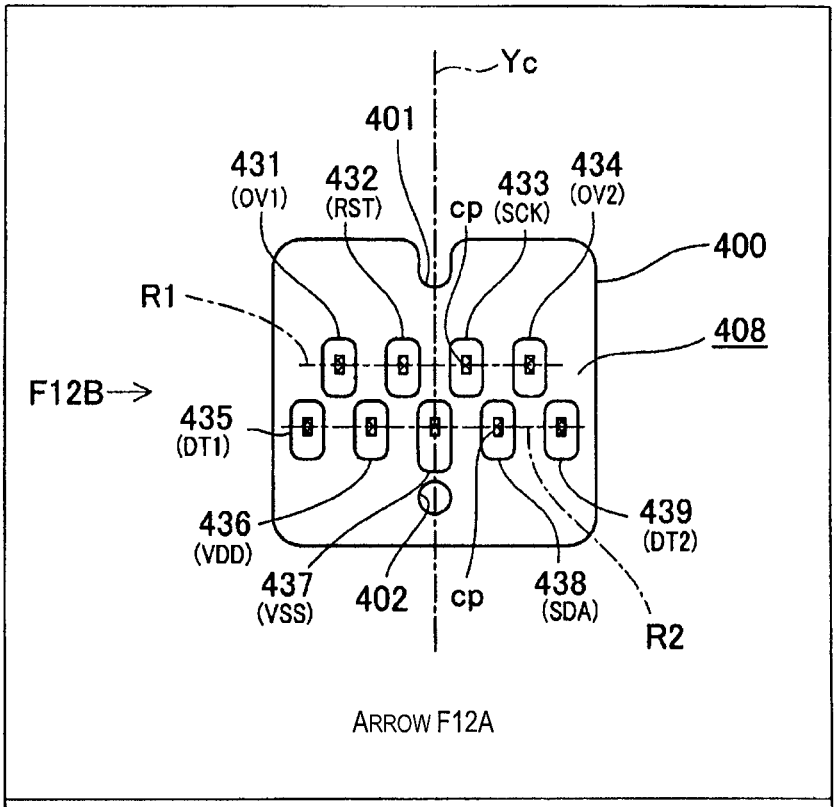
FIGS. 11A and 11B are explanatory diagrams illustrating a detailed configuration of a circuit substrate of a cartridge.
Figure 11B:
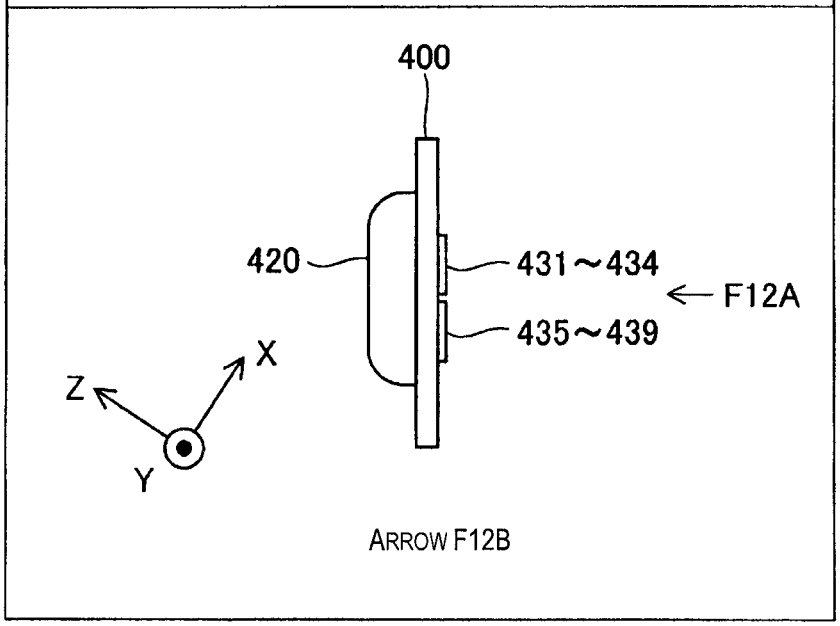

FIGS. 11A and 11B are explanatory diagrams illustrating a detailed configuration of the circuit substrate 400 of the cartridge 20. FIG. 11A which is the upper level in FIGS. 11A and 11B illustrates a configuration on the surface (cartridge side inclined surface) 408 of the circuit substrate 400 viewed from an arrow F12A in FIG. 9. FIG. 11B which is the lower level in FIGS. 11A and 11B illustrates a configuration of a side surface of the circuit substrate 400 viewed from an arrow F12B (+Y axial direction) in FIG. 11A.

As shown in FIG. 11A, a boss groove 401 is formed in an edge portion in the +Z axial direction side of the circuit substrate 400 and a boss hole 402 is formed in an edge portion in the −Z axial direction side of the circuit substrate 400. The circuit substrate 400 in a state of being arranged in the cartridge 20 is fixed to the eighth surface 208 of the cartridge 20 using the boss groove 401 and the boss hole 402. In the embodiment, the boss groove 401 and the boss hole 402 are provided in a position which cuts across the flat plane Yc which passes through the center of the width (length in the Y axial direction) of the cartridge 20. In another embodiment, at least one of the boss groove 401 and the boss hole 402 may be omitted from the circuit substrate 400, and the circuit substrate 400 may be fixed to the eighth surface 208 using an adhesive agent or the circuit substrate 400 may be fixed using an engaging claw (not shown) which is provided in the eighth surface 208 side.

In the embodiment, nine cartridge side terminals 431 to 439 are formed in the cartridge side inclined surface 408 of the circuit substrate 400 as shown in FIG. 11A, and a storage device 420 is provided on the rear surface as shown in FIG. 11B. In the embodiment, information which relates to the ink in the cartridge 20 (for example, residual amount of ink and ink color) is stored in the storage device 420 of the circuit substrate 400.

The number of cartridge side terminals in the circuit substrate 400 is not limited to nine, a change to an arbitrary number is possible, and there may be nine or less or may be nine or more. As shown in FIG. 11B, it is preferable that the cartridge side terminals 431 to 439 be the same height from the cartridge side inclined surface 480 of the circuit substrate 400 as each other.

Each of the cartridge side terminals 431 to 439 of the circuit substrate 400 has a contact portion cp which comes into contact with the device side terminals which are provided in the terminal platform 700 of the holder 600. Out of the cartridge side terminals 431 to 439, four of the cartridge side terminals 431 to 434 are lined up along a terminal array R1 which is parallel to the Y axis on the +Z axial direction side and five of the cartridge side terminals 435 to 439 are lined up along a terminal array R2 which is parallel to the Y axis more to the −Z axial direction side than the terminal array R1. The respective contact portions cp of the cartridge side terminals 431 to 434 on the terminal array R1 are positioned on the terminal array R1 and the respective contact portions cp of the cartridge side terminals 435 to 439 on the terminal array R2 are positioned on the terminal array R2.

When the cartridge side terminals 431 to 434 on the terminal array R1 and the cartridge side terminals 435 to 439 on the terminal array R2 do not overlap viewed from a direction along the Y axis, the cartridge side terminals 431 to 434 on the terminal array R1 are positioned more to the +Z axial direction side than the cartridge side terminals 435 to 439 on the terminal array R2. When cartridge side terminals 431 to 434 on the terminal array R1 and the cartridge side terminals 435 to 439 on the terminal array R2 do not overlap viewed from a direction along the Z axial direction, the cartridge side terminals 431 to 434 on the terminal array R1 and the cartridge side terminals 435 to 439 on the terminal array R2 are positioned to be different from each other.

Five of the cartridge side terminals 432, 433, 436, 437, and 438 are electrically connected to the storage device 420. The cartridge side terminal 432 functions as a "reset terminal" which receives supply of a reset signal RST with regard to the storage section 420. The cartridge side terminal 433 functions as a "clock terminal" which receives supply of a clock signal SCK with regard to the storage section 420. The cartridge side terminal 436 functions as a "power source terminal" which receives supply of a power source voltage VDD (for example, standard 3.3 volts) with regard to the storage section 420. The cartridge side terminal 437 functions as a "grounding terminal", that is, a "cartridge side grounding terminal", which receives supply of a grounding voltage VSS (0 volts) with regard to the storage section 420. The cartridge side terminal 438 functions as a "data terminal" which receives supply of a data signal SDA with regard to the storage section 420.

Four of the cartridge side terminals 431, 434, 435, and 439 function as "mounting detection terminals" which are used for carrying out detection of mounting of whether or not the cartridge 20 has been correctly mounted with regard to the holder 600 from the holder 600 side. Each of the contact portions cp of the other cartridge side terminals 432, 433, 436, 437, and 438 exist in a rectangular region with each of the contact points cp of the four cartridge side terminals 431, 434, 435, and 439 as the four corners. In the embodiment, the four cartridge side terminals 431, 434, 435, and 439 are electrically connected to each other in an inner portion of the circuit substrate 400 and are electrically connected to a grounding line (not shown) on the printer 50 side via the cartridge side terminal 437 which functions as the grounding terminal when the cartridge 20 is mounted in the holder 600.

In the embodiment, the nine cartridge side terminals 431 to 439 in the circuit substrate 400 are electrically connected to the control section 510 of the printer 50 via the device side terminals which are provided in the terminal platform 700 of the holder 600 in the mounting state where the cartridge 20 is mounted in the holder 600. Due to this, it is possible for the control section 510 to perform detection of the mounting of the cartridge 20 and it is possible to perform reading and writing of information with regard to the storage device 420 of the circuit substrate 400.

In the embodiment, the cartridge side terminal 437 which functions as the grounding terminal is provided in a position which cuts across the flat plane Yc which passes through the center of the width (length in the Y axial direction) of the cartridge 20 and is configured so as to come in contact with the device side terminal (not shown) prior to the other cartridge side terminals 431 to 436, 438, and 439 coming into contact with the device side terminals (not shown) when the cartridge 20 is mounted in the holder 600. Due to this, since the pressing force Pt which is initially added from the holder 600 to the circuit substrate 400 is generated in the center in the width of the cartridge 20 in a direction along the Y axis, it is possible to suppress an action where the pressing force Pt which is added to the cartridge side inclined surface 408 works as a force to incline the cartridge 20 in the Y axial direction and to mount the cartridge 20 in the holder 600 in a posture which is stabilized. In addition, since the cartridge side terminal 437 which functions as the grounding terminal comes into contact with the device side terminal before the other cartridge side terminals 431 to 436, 438, and 439, it is possible to reduce defects due to a high voltage using the grounding function of the cartridge side terminal 437 even in a case where a high voltage which is not intended is applied to the cartridge 20 side.

In the embodiment, the cartridge side terminal 437 which functions as the grounding terminal is formed to be longer in a direction along the Z axis than the other cartridge side terminals 431 to 436, 438, and 439. Due to this, it is possible for contact between the cartridge side terminal 437 which functions as the grounding terminal and the device side terminals (not shown) which is provided in the terminal platform 700 of the holder 600 to more reliably occur before contact between the other cartridge side terminals 431 to 436, 438, and 439 and the device side terminals 731 to 736, 738, and 739. In another embodiment, all of the cartridge side terminals 431 to 439 may be formed with the same size as each other.

Figure 12A:
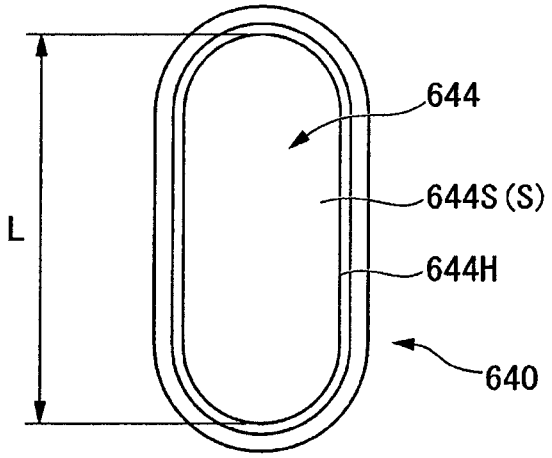
FIGS. 12A and 12B are expanded diagrams of an ink supply pipe of a holder and an ink supply port of a cartridge.
Figure 12B:
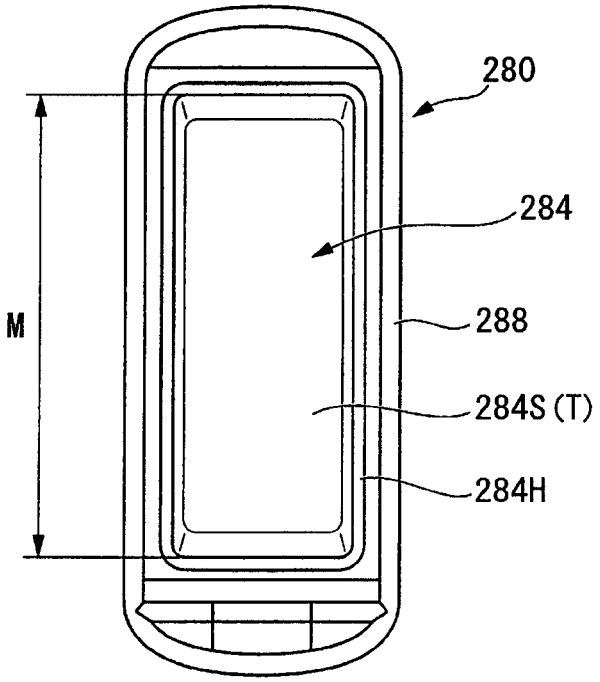

FIGS. 12A and 12B are expanded diagrams of the ink supply pipe 640 of the holder 600 and the ink supply port 280 of the cartridge 20. FIG. 12A is an expanded diagram of the ink supply pipe 640 of the holder 600 (an expanded diagram of F12A in FIG. 4). FIG. 12B is an expanded diagram of the ink supply port 280 of the cartridge 20 (expanded diagram of F12B of FIG. 10).

The porous filter 644 is in the ink supply pipe 640 of the holder 600. The porous filter 644 is welded with regard to the ink supply pipe 640. A welding mark 644H with an elliptical annular shape appears in the surface of the porous filter 644. The ink is supplied via the porous filter 644.

Out of the ink in the porous filter 644, the ink able to pass is in a range which is encompassed by the welding mark 644H. The range (portion) is an effective section 644S.

A dimension L of the effective section 644S in the depth direction is 8.8 mm.

The area S of the effective section 644S is 35.25 $mm^2$.

The effective dimension L of the ink supply pipe 640 in the depth direction is regulated by the dimension L of the effective section 644S of the porous filter 644 in the depth direction. That is, the effective dimension L of the ink supply pipe 640 in the depth direction is the dimension L of the effective section 644S of the porous filter 644 in the depth direction.

The effective area S of the ink supply pipe 640 is regulated by the area S of the effective section 644S of the porous filter 644. That is, the effective area S of the ink supply pipe 640 is the area S of the effective section 644S of the porous filter 644.

The foam resin body 284 is in the ink supply port 280 in the cartridge 20. The foam resin body 284 is welded with regard to the ink supply port 280. A welding mark 284H with an elliptical annular shape appears in the surface of the foam resin body 284. The ink is supplied via the foam resin body 284.

Out of the ink in the foam resin body 284, the ink able to pass is in a range which is encompassed by the welding mark 284H. The range (portion) is an effective section 284S.

A dimension M of the effective section 284S in the depth direction is 8.8 mm or more and 44 mm or less. The optimal value of the effective section 284S in the depth direction is 18.3 mm.

The area T of the effective section 284S is 35.25 $mm^2$ or more and 176.25 $mm^2$ or less. The optimal value of the area T of the effective section 284S is 131.76 $mm^2$.

The effective dimension M of the ink supply port 280 in the depth direction is regulated by the dimension M of the effective section 284S of the foam resin body 284 in the depth direction. That is, the effective dimension M of the ink supply port 280 in the depth direction is the dimension M of the effective section 284S of the foam resin body 284 in the depth direction.

The effective area T of the ink supply port 280 is regulated by the area T of the effective section 284S of the foam resin body 284. That is, the effective area T of the ink supply port 280 is the area T of the effective section 284S of the foam resin body 284.

The effective area T of the ink supply port 280 is 35.25 $mm^2$ or more and 176.25 $mm^2$ or less. The effective area S of the ink supply pipe 640 is 35.25 $mm^2$.

Accordingly, the effective area T of the ink supply port 280 is the same or more and five times or less than the effective area S of the ink supply pipe 640. In a case where the area T of the effective section 284S is the optimal value of 131.76 $mm^2$, the effective area T of the ink supply port 280 is 3.74 times the effective area S of the ink supply pipe 640.

It is possible to reduce flow path resistance of the ink supply port 280 by the effective area T of the ink supply port 280 being the same or more as the effective area S of the ink supply pipe 640. The flow resistance is reduced by widening the flow path. Accordingly, it is possible to provide the cartridge 20 with a high printing material supply capacity. As such, it is possible for the printer 50 to realize high speed printing.

In addition, by the effective area T of the ink supply port 280 being five times or less than the effective area S of the ink supply pipe 640, it is possible to prevent ink being vaporized and solidification in the vicinity of the ink supply port 280.

Furthermore, the effective area T of the ink supply port 280 is preferably 70.5 $mm^2$ or more and 158.63 $mm^2$ or less. The effective area S of the ink supply pipe 640 is 35.25 $mm^2$.

In this case, the effective area T of the ink supply port 280 is two times or more and is 4.5 times or less than the effective area S of the ink supply pipe 640.

It is possible to further reduce flow path resistance of the ink supply port 280 and it is possible to provide the cartridge 20 with a higher printing material supply capacity. In addition, it is possible to more reliably prevent ink being vaporized and solidification in the vicinity of the ink supply port 280.

In particular, it is preferable that the effective area T of the ink supply port 280 be 105.75 $mm^2$ or more and 141 $mm^2$ or less. The effective area S of the ink supply pipe 640 is 35.25 $mm^2$.

In this case, the effective area T of the ink supply port 280 is three times or more and is four times or less than the effective area S of the ink supply pipe 640.

It is possible to reduce flow path resistance of the ink supply port 280 to be extremely small and it is possible to provide the cartridge 20 with a remarkably high printing material supply capacity. In addition, it is possible to further reliably prevent ink being vaporized and solidification in the vicinity of the ink supply port 280.

The depth D of the cartridge 20 is larger than the height H of the cartridge 20 and the height H of the cartridge 20 is larger than the width W of the cartridge 20. In addition, the effective dimension M of the ink supply port 280 in the depth direction is 8.8 mm or more and 44 mm or less. The effective dimension L of the ink supply pipe 640 in the depth direction is 8.8 mm.

Accordingly, the effective dimension M of the ink supply port 280 in the depth direction is the same as or more and five times or less than the effective dimension L of the ink supply pipe 640 in the depth direction. In a case where the effective section 284S in the depth direction is the optimal value of 18.3 mm, the effective dimension M of the ink supply port 280 in the depth direction is 2.08 times the effective dimension L of the ink supply pipe 640 in the depth direction.

In the cartridge 20 which is the largest in the depth direction, there is not a tendency towards the size of the cartridge 20 increasing due to the size in the depth direction being effectively utilized and it is possible to realize the effects described above.

Furthermore, the depth of the cartridge 20 is larger than the height H of the cartridge 20 and the height H of the cartridge 20 is larger than the width W of the cartridge 20. Then, it is preferable that the effective dimension M of the ink supply port 280 in the depth direction be 13.2 mm or more and 35.2 mm or less. The effective dimension L of the ink supply pipe 640 in the depth direction is 8.8 mm.

In this case, the effective dimension M of the ink supply port 280 in the depth direction is 1.5 times or more and is four times or less than the effective dimension L of the ink supply pipe 640 in the depth direction.

In the cartridge 20 which is the largest in the depth direction, there is not a tendency towards the size of the cartridge 20 increasing due to the size in the depth direction being effectively utilized and it is possible to more reliably realize the effects described above.

In particular, the depth of the cartridge 20 is larger than the height H of the cartridge 20 and the height H of the cartridge 20 is larger than the width W of the cartridge 20. Then, it is preferable that the effective dimension M of the ink supply port 280 in the depth direction be 17.6 mm or more and 26.4 mm or less. The effective dimension L of the ink supply pipe 640 in the depth direction is 8.8 mm.

In this case, the effective dimension M of the ink supply port 280 in the depth direction is two times or more and is three times or less than the effective dimension L of the ink supply pipe 640 in the depth direction.

In the cartridge 20 which is the largest in the depth direction, there is not a trend towards increasing the size of the cartridge 20 due to the size in the depth direction being effectively utilized and it is possible to further reliably realize the effects described above.

Cartridge Attaching and Detaching Operation Regarding Holder

Figure 13:
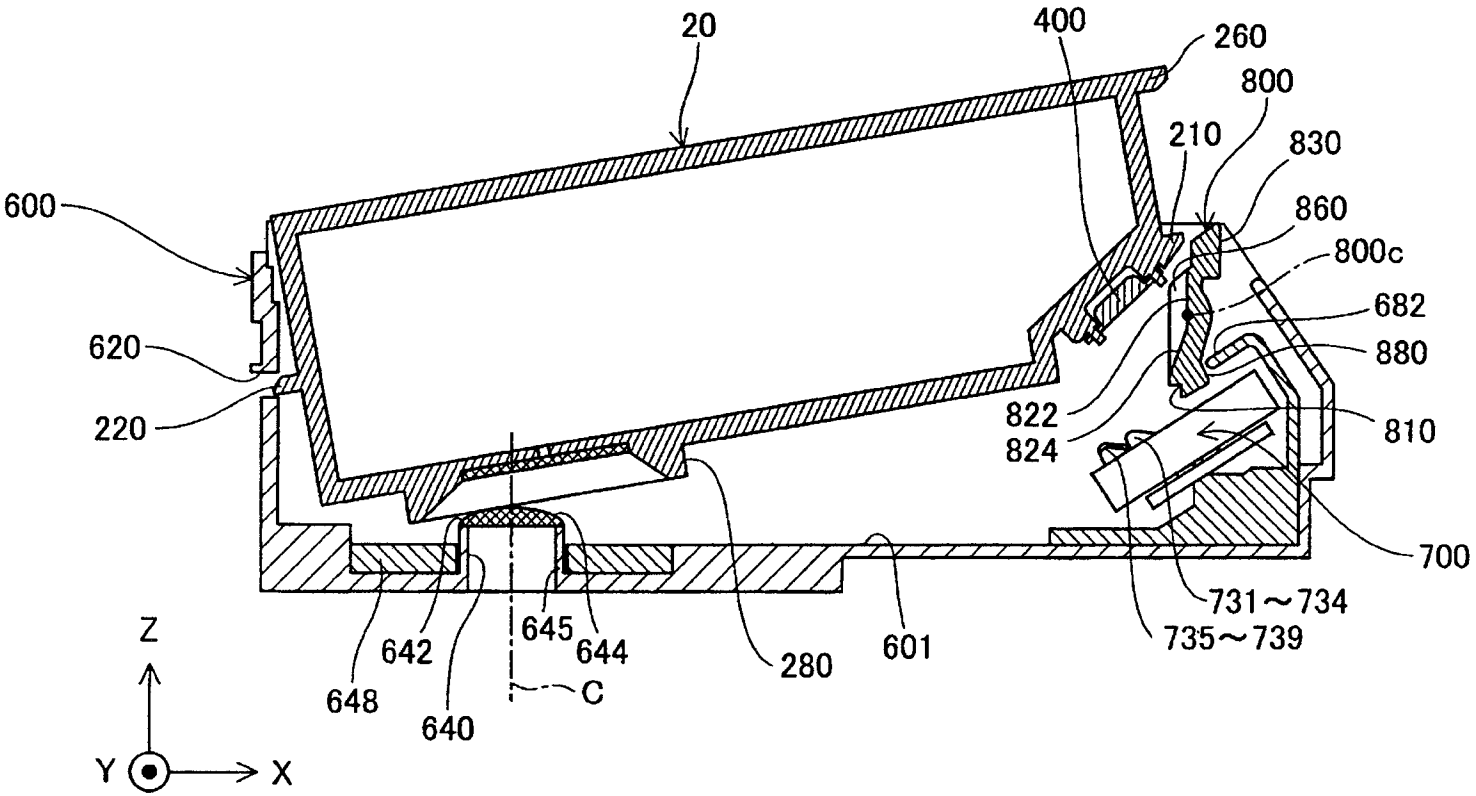
FIG. 13 is an explanatory diagram illustrating an attaching and detaching operation of a cartridge with regard to a holder.
Figure 14:
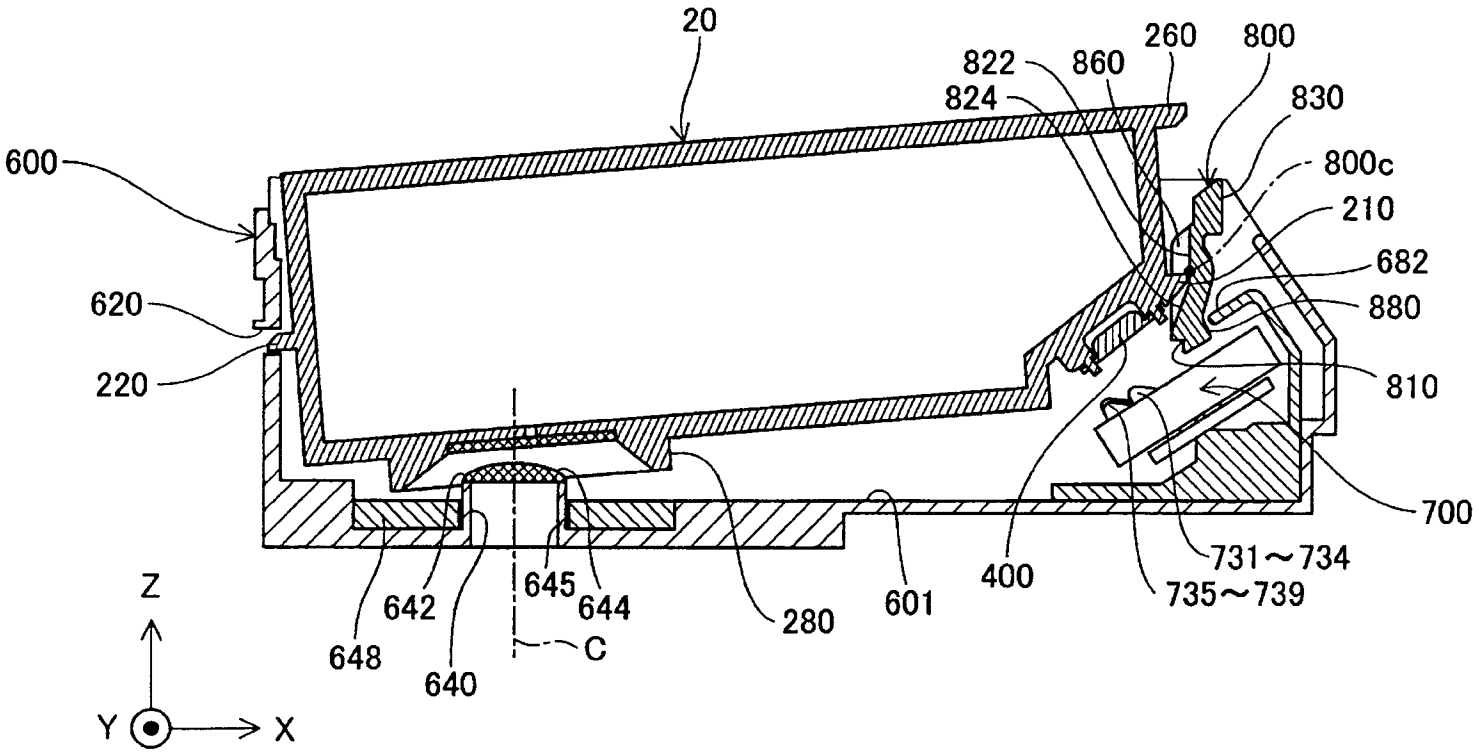
FIG. 14 is an explanatory diagram illustrating an attaching and detaching operation of a cartridge with regard to a holder.
Figure 15:
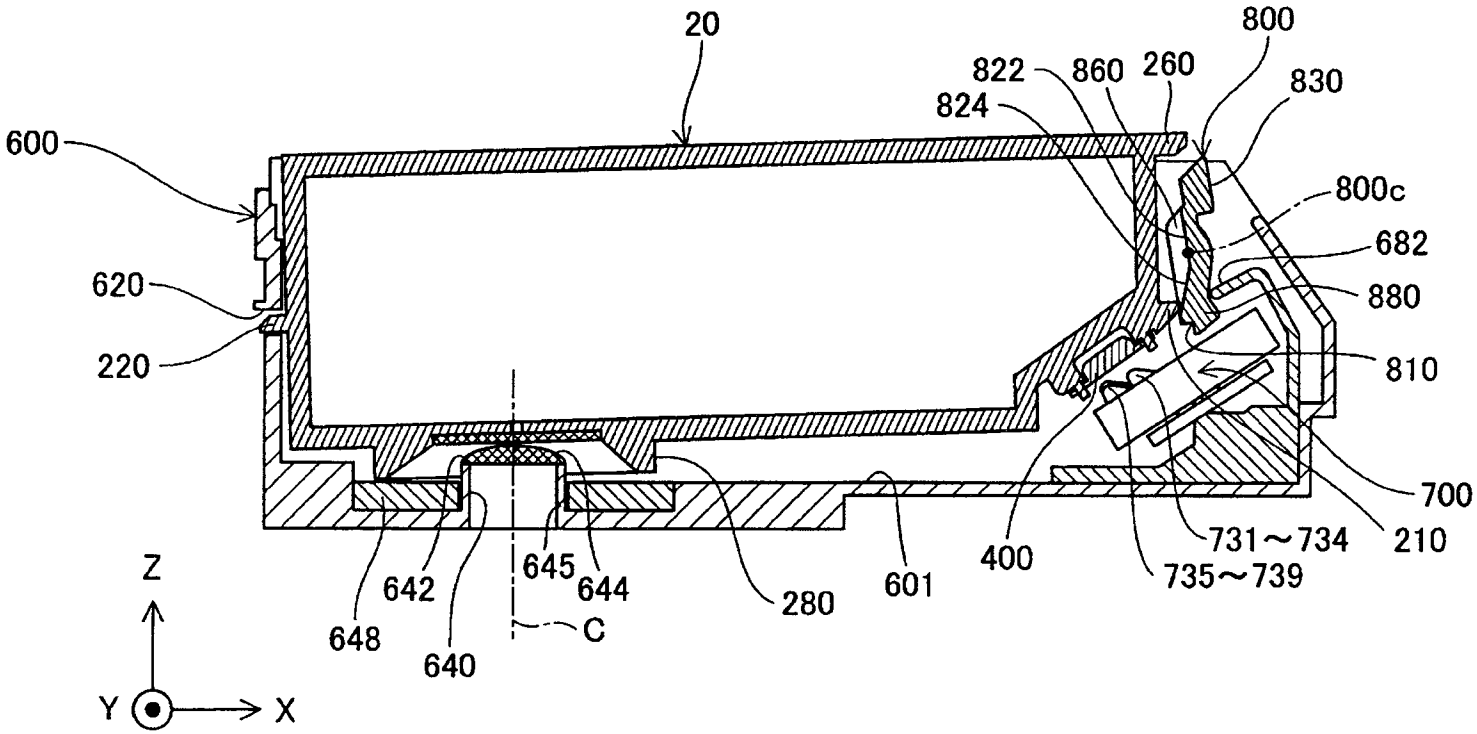
FIG. 15 is an explanatory diagram illustrating an attaching and detaching operation of a cartridge with regard to a holder.
Figure 16:
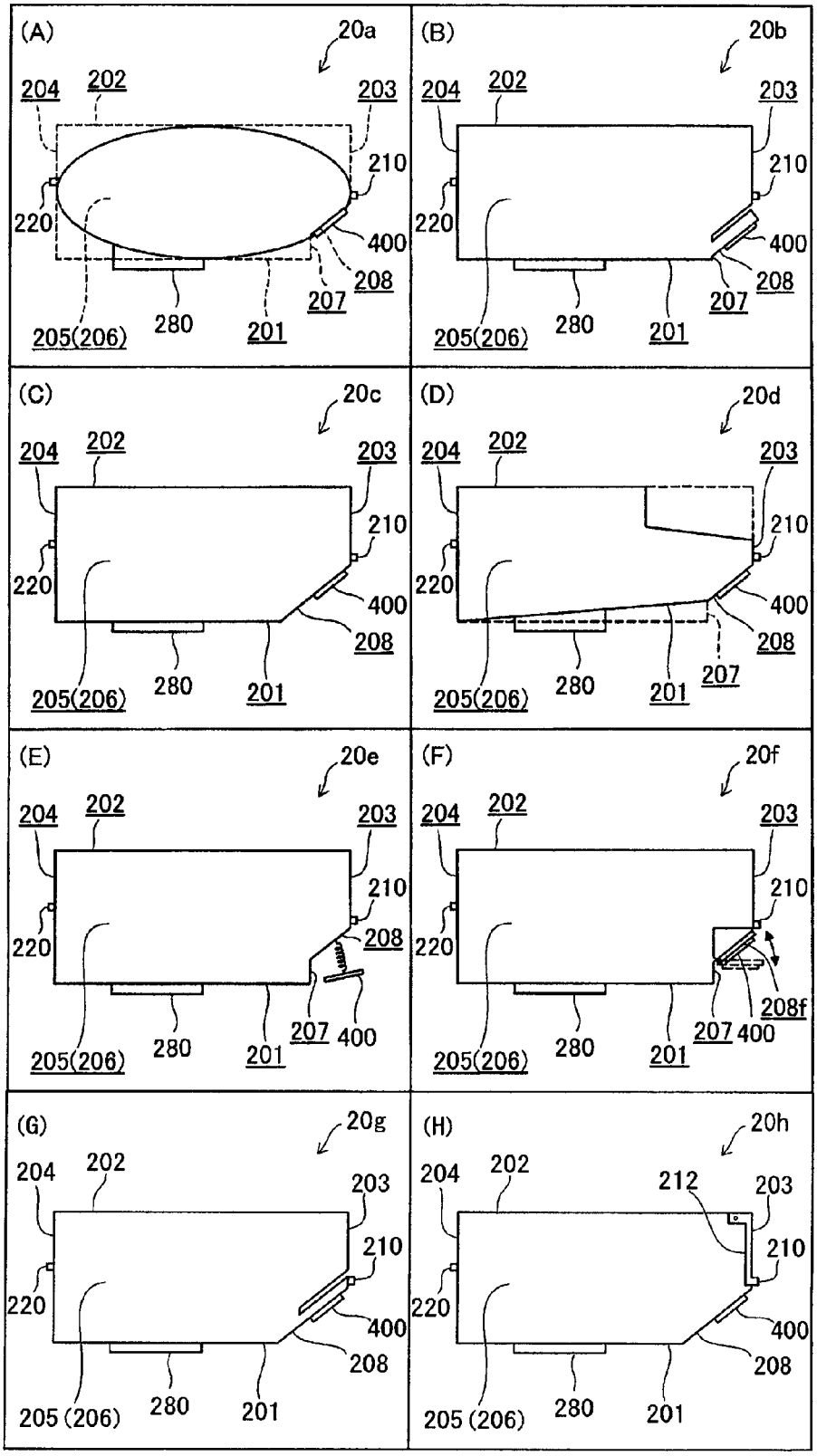
FIG. 16 includes diagrams (A) to (H) that are explanatory diagrams illustrating modified examples of an outer appearance of a cartridge.

FIG. 13, FIG. 14, and FIG. 15 are explanatory diagrams illustrating an attaching and detaching operation of the cartridge 20 with regard to the holder 600. The cartridge 200 and the holder 600 with a cross section in a position which corresponds to FIG. 5 are illustrated in FIG. 13 to FIG. 15.

As shown in FIG. 13, when the cartridge 20 is mounted in the holder 600, the cartridge 20 is moved into an inner portion of the holder 600 in the −Z axial direction from the second cartridge side fastening section 220 side and the second cartridge side fastening section 220 is inserted into the second device side fastening section 620. In the state shown in FIG. 13, the first cartridge side fastening section 210 in the cartridge 20 is positioned in the +Z axial direction side of the first device side fastening section 810 which is in the lever 800 on the holder 600 side.

Next, from the state shown in FIG. 13, the cartridge 20 is rotated with the second cartridge side fastening section 220 which is inserted in the second device side fastening section 620 as the rotation pivot in a clockwise direction viewed from the −Y axial direction, that is, by the third surface 203 side being pushed toward a wall section 601 side in the holder 600. By doing this, as shown in FIG. 14, the first cartridge side fastening section 210 progresses in the −Z axial direction with movement in the Y axial direction being limited by the first cartridge side fastening section 210 being guided between a pair of wall sections 860 in the lever 800 and with movement in the ZX axial direction being limited by the first cartridge side fastening section 210 coming in contact with a flat plane 822 between the pair of wall sections 860.

From the state shown in FIG. 14, the third surface 203 side of the cartridge 20 is further rotated by being pushed. By doing this, the first cartridge side fastening section 210 is further pressed in the −Z axial direction and progresses from on the flat plane 822 of the lever 800 onto the inclined surface 824. Then, as shown in FIG. 15, the inclined surface 824 of the lever 800 comes closer to being in a state which is parallel to the Z axis due to the lever 800 being rotated in a counter-clockwise direction viewed from the +Y axial direction side. In the state shown in FIG. 15, the first cartridge side fastening section 210 progresses in the −Z axial direction onto the inclined surface 824 which is closer to being in a state which is parallel to the Z axis. At this time, in the embodiment, an abutting section 880 on a rear surface of the lever 800 abuts against an elastic member 682 and receives a pressing force, which presses to return the lever 800 in a clockwise direction viewed from the +Y axial direction, from the elastic member 682. The pressing force is an external force which includes components in the −Z axial direction. That is, the rotation area of the lever 800 is limited by the elastic member 682. A state, where the lever 800 is abutting against and is pressing the elastic member 682, is maintained from the state shown in FIG. 15 until the cartridge 20 is further pressed and the first cartridge side fastening section 210 gets past the inclined surface 824 of the lever 800.

When the cartridge 20 is further rotated from the state shown in FIG. 15 and the first cartridge side fastening section 210 has passed by the inclined surface 824 of the lever 800 and gets past a surface edge section 828, the lever 800 is returned to its original position and the first device side fastening section 810 moves to the first fastening position 810L and is fastened to the first cartridge side fastening section 210 as shown in FIG. 5. In addition, the ink supply port 280 of the cartridge 20 is connected to the ink supply pipe 640, and the second cartridge side fastening section 220 and the second device side fastening section 620 are engaged. Due to this, the mounting of the cartridge 20 with regard to the holder 600 is completed. In addition, by the cartridge 20 being correctly mounted in the designed mounting position, the cartridge side terminals 431 to 439 and the device side terminals 731 to 739 are electrically connected and transferring of signals between the cartridge 20 and the printer 50 is performed.

In addition, in the embodiment, at the same time as the first cartridge side fastening section 210 passing by the inclined surface 824 of the lever 800 and gets past the surface edge section 828, the elastic member 682 is separated from the abutting section 880 on the rear surface of the lever 800. Due to this, it is possible to impart a clicking sensation to the user when the cartridge 20 is mounted into the holder 600.

In addition, in the embodiment, the elastic member 682 does not abut against the lever 800 and an external force is not added in a state where the cartridge 20 is mounted in the holder 600. Due to this, it is possible to prevent a change in shape of the lever 800 due to consistent pressing by the elastic member 682.

In another embodiment, the elastic member 682 may abut against the lever 800 and press the lever 800 in a direction which includes components in the −X axial direction even in a state where the cartridge 20 is mounted in the holder 600. Due to this, it is possible to more strongly impart a clicking sensation to the user when the cartridge 20 is mounted in the holder 600. In another embodiment, the elastic member 682 may be omitted. Due to this, it is possible to reduce the number of parts.

Effects

As described above, according to the embodiment, it is possible to reduce flow path resistance in the ink supply port 280 by the effective area T of the ink supply port 280 of the cartridge 20 being the same or more as the effective area S of the ink supply pipe 640 of the holder 600. That is, the flow resistance is reduced by widening the flow path. Accordingly, it is possible to provide the cartridge 20 with a high printing material supply capacity. As such, it is possible for the printer 50 to realize high speed printing.

In addition, by the effective area T of the ink supply port 280 being five times or less than the effective area S of the ink supply pipe 640, it is possible to prevent ink being vaporized and solidification in the vicinity of the ink supply port 280.

Furthermore, it is possible to more reliably realize the effects described above by the effective area T of the ink supply port 280 being two times or more and is 4.5 times or less than the effective area S of the ink supply pipe 640.

In particular, it is possible to further reliably realize the effects described above by the effective area T of the ink supply port 280 being three times or more and is four times or less than the effective area S of the ink supply pipe 640.

Since the effective dimension M of the ink supply port 280 in the depth direction is the same as or more and five times or less than the effective dimension L of the ink supply pipe 640 in the depth direction in a case where the depth D of the cartridge 20 is larger than the height H of the cartridge 20 and the height H of the cartridge 20 is larger than the width W of the cartridge 20, there is not a tendency towards the size of the cartridge 20 in the depth direction increasing due to effective utilization and it is possible to realize the effects described above.

Furthermore, since the effective dimension M of the ink supply port 280 in the depth direction is 1.5 times or more and is four times or less than the effective dimension L of the ink supply pipe 640 in the depth direction in a case where the depth D of the cartridge 20 is larger than the height H of the cartridge 20 and the height H of the cartridge 20 is larger than the width W of the cartridge 20, it is possible to more reliably realize the effects described above.

In particular, since the effective dimension M of the ink supply port 280 in the depth direction is two times or more and is three times or less than the effective dimension L of the ink supply pipe 640 in the depth direction in a case where the depth D of the cartridge 20 is larger than the height H of the cartridge 20 and the height H of the cartridge 20 is larger than the width W of the cartridge 20, it is possible to further reliably realize the effects described above.

Modified Examples of Outer Appearance of Cartridge

FIGS. 16(A) to 16(H) are explanatory diagrams illustrating modified examples of an outer appearance of a cartridge. In FIG. 16, eight modified examples which are different in terms of the outer appearance of the cartridge are each illustrated in FIG. 16(A) to FIG. 16(H). The same reference numerals are given with regard to configurations which are the same as the cartridge 20 in the embodiment and the description thereof is omitted.

The outer shell of a cartridge 20*a* in FIG. 16(A) has a side surface which is an elliptical shape or an oval shape. The first cartridge side fastening section 210 and the circuit substrate 400 are provided on the front surface side of the cartridge 20*a*. The ink supply port 280 is formed on the bottom surface side of the cartridge 20*a*. The second cartridge side fastening section 220 is formed on the rear surface side of the cartridge 20*a*. The cartridge 20*a* has a constant width when the cartridge 20*a* is viewed from the front surface side.

A cartridge 20*b* in FIG. 16(B) is the same as the cartridge 20 of the embodiment excluding the point where the eighth surface 208 is connected to the −Z axial direction side of the third surface 203.

A cartridge 20*c* in FIG. 16(C) is the same as the cartridge 20 of the embodiment excluding the point where the seventh surface 207 is omitted by extending the eighth surface 208 to the first surface 201.

A cartridge 20*d* in FIG. 16(D) is the same as the cartridge 20 of the embodiment excluding the point where the point where there is an arrangement where a portion where the second surface 202 and the third surface 203 intersect is cut off and the point where the seventh surface 207 is omitted by the first surface 201 being inclined to the eighth surface 208.

A cartridge 20*e* in FIG. 16(E) is the same as the cartridge 20 of the embodiment excluding the point where the circuit substrate 400 is attached to the eighth surface 208 via a spring.

A cartridge 20*f* in FIG. 16(F) is the same as the cartridge 20 of the embodiment excluding the point where a surface 208*f* which is equivalent to the eighth surface 208 is configured to be movable and the circuit substrate 400 is provided in the surface 208*f*.

In a cartridge 20*g* in FIG. 16(G), the seventh surface 207 is omitted by extending the eighth surface 208 to the first surface 201, and furthermore, a groove is formed with a shape which is cut out substantially in parallel with the eighth surface 208 from a midpoint in the third surface 203. Then, the first cartridge side fastening section 210 is provided at a portion which is closer to the eighth surface out of two portions of the eighth surface 208 which are separated by the groove. Excluding these points, the cartridge 20*g* in FIG. 16(G) is the same as the cartridge 20 of the embodiment.

In a cartridge 20*h* in FIG. 16(H), the seventh surface 207 is omitted by extending the eighth surface 208 to the first surface 201, and furthermore, the third surface 203 and the first cartridge side fastening section 210 are provided in an arm 212 which is fixed to be able to rotate centered on a pivot with regard to the main body of the cartridge. Excluding these points, the cartridge 20*h* in FIG. 16(H) is the same as the cartridge 20 of the embodiment.

In any of the cartridges 20*a* to 20*h* which are the respective modified examples in FIGS. 16(A) to 16(H), each of the first cartridge side fastening section 210, the second cartridge side fastening section 220, the ink supply port 280, and the circuit substrate 400 are provided in positions which correspond to the cartridge 20 of the embodiment. Due to this, any of the cartridges 20*a* to 20*h* which are the respective modified examples are compatible with the cartridges 20 in the embodiment.

As is understood from each of the modified examples in FIGS. 16(A) to 16(H), various modified examples can be considered in regard to the shape of the outer appearance of the cartridge. Even in a case where the shape of the outer appearance of the cartridge has a shape other than a shape which is substantially rectangular, it is possible to consider six surfaces which are substantially rectangular in a virtual manner as shown by dotted lines in FIG. 16(A) and FIG. 16(D), that is, for example, the first surface 201 (the bottom surface), the second surface 202 (the upper surface), the third surface 203 (the front surface), the fourth surface 204 (the rear surface), the fifth surface 205 (the left side surface), and the sixth surface 206 (right side surface) shown in FIG. 6 and FIG. 7.

In the specifications, the term "surface" (plane) is used with a meaning which encompasses both a plane in a virtual manner (a virtual plane, a plane which does not actually exist) and an actual surface such as described in FIG. 6 and FIG. 7. In addition, in the specifications, the term "surface" is used with the meaning which encompasses both a flat plane and a curved plane.

Cartridge Using Adaptor

Figure 17:
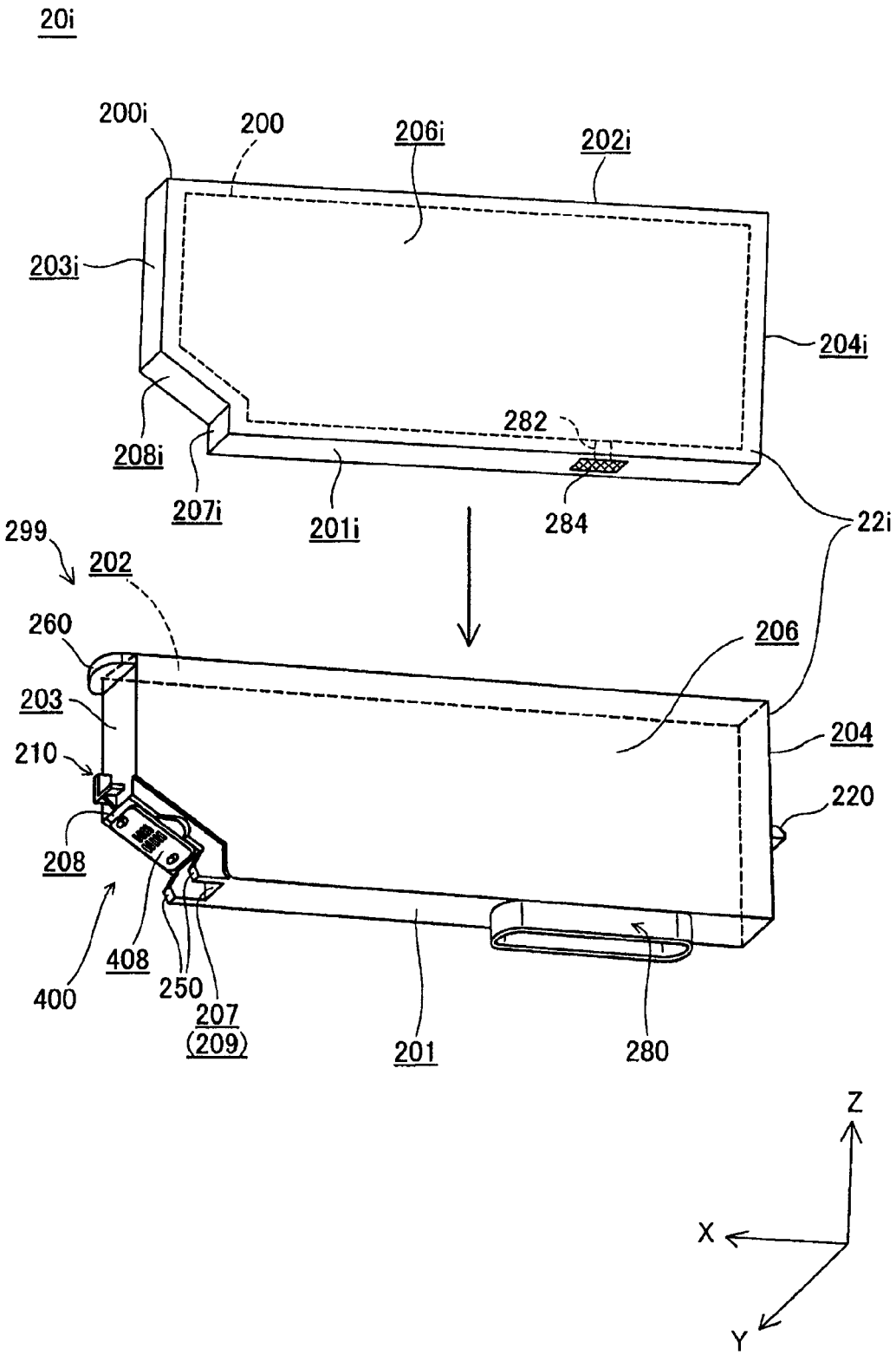
FIG. 17 is an explanatory diagram illustrating a configuration of a cartridge which uses an adapter.

FIG. 17 is a perspective diagram illustrating a configuration of a cartridge 20*i* which uses an adapter 299. The cartridge 20*i* is configured to be able to be separate a containing member 200*i* and the adaptor 299. The containing member 200*i* has the printing material containing section 200 which contains the printing material in an inner portion thereof. In a case where there is no longer any printing material in the printing material containing section 200, it is possible to exchange the containing member 200*i* with a new containing member 200*i* or replenish the printing material in the printing material containing member 200. When performing exchanging of the containing member 200*i* or replenishing of the printing material, it is possible to reuse the adaptor 299. The cartridge 20*i* in FIG. 17 is compatible with the cartridge 20 of the embodiment shown in FIG. 6.

An outer shell 22*i* of the cartridge 20*i* is configured from a combination of the outer shell of the containing member 200*i* and the outer shell of the adaptor 299. The containing member 200*i* has the ink flow path 282 and the foam resin body 284 in addition to the printing material containing section 200.

The containing member 200*i* of the cartridge 20*i* is provided with a second surface 202*i* which is equivalent to the second surface 202 of the cartridge 20*i*. The containing member 200*i* is provided with a first surface 201*i*, a third surface

203*i*, a fourth surface 204*i*, a fifth surface (not shown), a sixth section 206*i*, a seventh surface 207*i*, and an eighth surface 208*i* which respectively correspond to the first surface 201 and the third to the eighth surfaces 203 to 208 of the cartridge 20*i*.

The first surface 201*i* and the second surface 202*i* oppose each other in the Z axial direction, the first surface 201*i* is positioned on the −Z axial direction side, and the second surface 202*i* is positioned on the +Z axial direction side. The third surface 203*i* and the fourth surface 204*i* oppose each other in the X axial direction, the third surface 203*i* is positioned on the +X axial direction side, and the fourth surface 204*i* is positioned on the −X axial direction side. The fifth surface (not shown) and the sixth surface 206*i* oppose each other in the Y axial direction, the fifth surface (not shown) is positioned on the +Y axial direction side, and the sixth surface 206*i* is positioned on the −Y axial direction side. The seventh surface 207*i* and the eighth surface 208*i* form connection surfaces which connect the first surface 201*i* and the third surface 203*i*.

The seventh surface 207*i* is a surface which intersects at a right angle with the first surface 201*i*. The seventh surface 207*i* is a surface (YZ flat plane) which is parallel to the Y axis and the Z axis. The seventh surface 207*i* as a step surface is a surface which is erected with regard to the first surface 201*i*. That is, the seventh surface 207*i* is a surface which extends from the first surface 201*i* in the +Z axial direction. The seventh surface 207*i* is positioned at the −X axial direction side and the −Z axial direction side with regard to the eighth surface 208*i*

The eighth surface 208*i* is a surface which is connected the seventh surface 207*i* and the third surface 203*i*. The eighth surface 208*i* is an inclined surface which is inclined toward a direction which includes components in the +X axial direction and the −Z axial direction. The eighth surface 208*i* is a surface which is inclined with regard to the first surface 201*i* and the third surface 203*i*. The eighth surface 208*i* is a surface which intersects at a right angle with the fifth surface 205*i* and the sixth surface 206*i*. The eighth surface 208*i* is inclined with regard to the XY flat plane and the YZ flat plane and intersects at a right angle with regard to the XZ flat plane.

The adaptor 299 of the cartridge 20*i* is provided with surfaces which are equivalent to each of the first surface 201, the third surface 203, the fourth surface 204, the fifth surface 205, the sixth surface 206, the seventh surface 207, and the eighth surface 208 of the cartridge 20*i*. The surface which is equivalent to the second surface 202 of the cartridge 20*i* out of the surfaces of the adaptor 299 is an opening. A space which receives the containing member 200*i* is formed in an inner portion of the adaptor 299. The ink supply port 280 is provided in the first surface 201 of the adaptor 299.

The configuration of the cartridge 20*i* of FIG. 17 is the same as the cartridge 20 of the embodiment which is shown in FIG. 6 including the modified examples excluding the point where the containing member 200*i* and the adaptor 299 are able to be separated as described above. Here, in another embodiment or another modified example, a configuration where the containing member and the adaptor are able to be separated may be adopted as with the cartridge 20*i* of FIG. 17. Here, the dimensions and ratios of each section in the cartridge 20*i* of FIG. 17 may be dimensions and ratios which are the same as the embodiment even though there are portions which are different to the embodiment.

Figure 18:
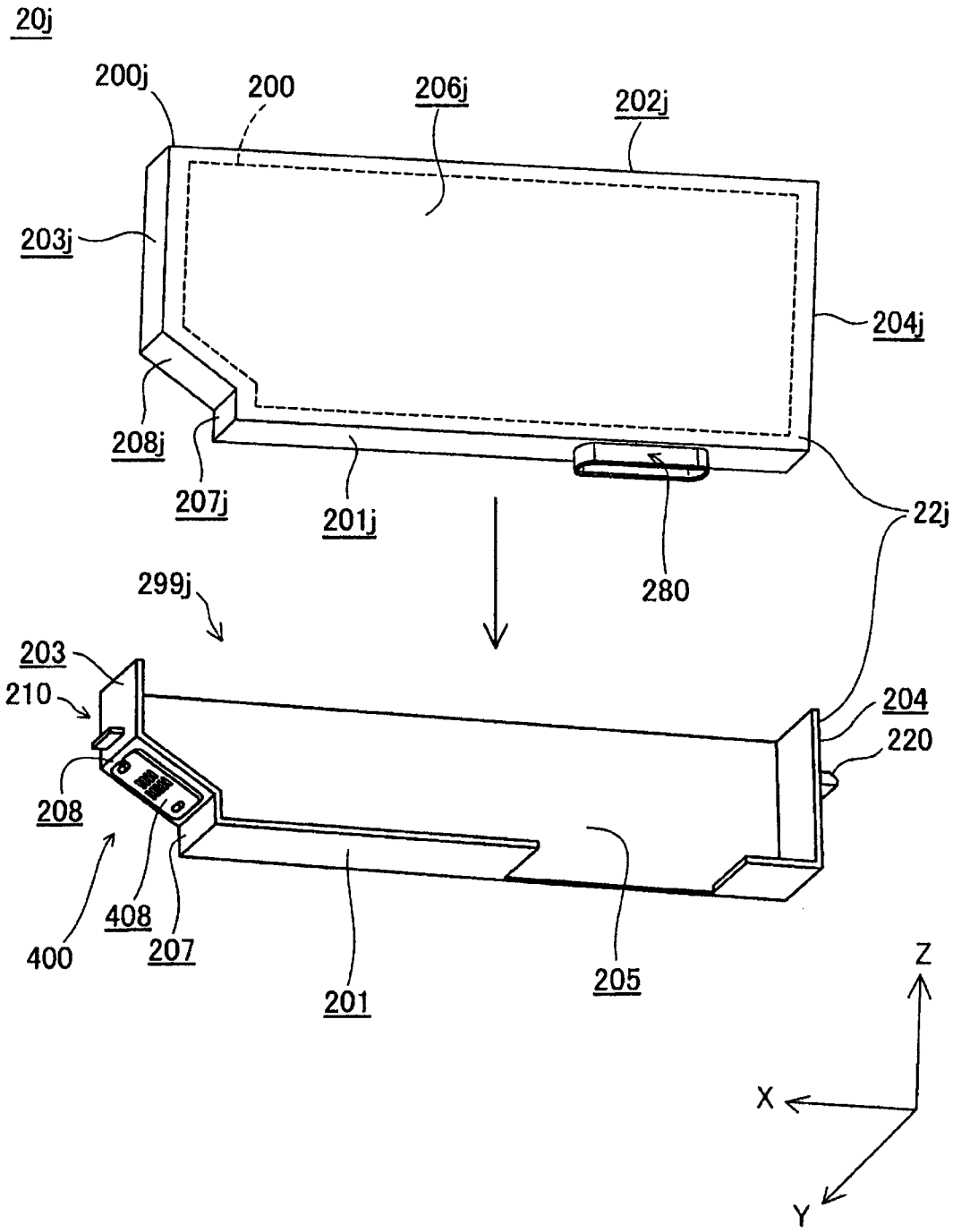
FIG. 18 is an explanatory diagram illustrating a configuration of a cartridge which uses an adapter.

FIG. 18 is a perspective diagram illustrating a configuration of a cartridge 20*j* which uses an adapter. The cartridge 20*j* is configured to be able to be separate a containing member 200*j* and an adaptor 299*j*. The containing member 200*j* has the printing material containing section 200 which contains the printing material in an inner portion thereof. In a case where there is no longer any printing material in the printing material containing section 200, it is possible to exchange the containing member 200*j* with a new containing member 200*j* or replenish the printing material in the printing material containing member 200. When performing exchanging of the containing member 200*j* or replenishing of the printing material, it is possible to reuse the adaptor 299*j*. The cartridge 20*j* in FIG. 18 is compatible with the cartridge 20 of the embodiment shown in FIG. 6.

An outer shell 22*j* of the cartridge 20*j* is configured from a combination of the outer shell of the containing member 200*j* and the outer shell of the adaptor 299*j*. The containing member 200*j* has the printing material containing section 200 and the ink supply port 280.

The containing member 200*j* of the cartridge 20*j* is provided with a second surface 202*j* and a sixth surface 206*j* which are respectively equivalent to the second surface 202 and the sixth surface 206 of the cartridge 20*j*. The containing member 200*j* is provided with a first surface 201*j*, a third surface 203*j*, a fourth surface 204*j*, a fifth surface (not shown), a seventh surface 207*j*, and an eighth surface 208*j* which respectively correspond to the first surface 201, the third surface 203, the fourth surface 204, the fifth surface 205, the seventh surface 207, and the eighth surface 208 of the cartridge 20*j*.

The first surface 201*j* and the second surface 202*j* oppose each other in the Z axial direction, the first surface 201*j* is positioned on the −Z axial direction side, and the second surface 202*j* is positioned on the +Z axial direction side. The third surface 203*j* and the fourth surface 204*j* oppose each other in the X axial direction, the third surface 203*j* is positioned on the +X axial direction side, and the fourth surface 204*j* is positioned on the −X axial direction side. The fifth surface (not shown) and the sixth surface 206*j* oppose each other in the Y axial direction, the fifth surface (not shown) is positioned on the +Y axial direction side, and the sixth surface 206*j* is positioned on the −Y axial direction side. The seventh surface 207*j* and the eighth surface 208*j* form connection surfaces which connect the first surface 201*j* and the third surface 203*j*.

The seventh surface 207*j* is a surface which intersects at a right angle with the first surface 201*i*. The seventh surface 207*j* is a surface (YZ flat plane) which is parallel to the Y axis and the Z axis. The seventh surface 207*j* as a step surface is a surface which is erected with regard to the first surface 201*j*. That is, the seventh surface 207*j* is a surface which extends from the first surface 201*j* in the +Z axial direction. The seventh surface 207*j* is positioned at the −X axial direction side and the −Z axial direction side with regard to the eighth surface 208*j*.

The eighth surface 208*j* is a surface which is connected the seventh surface 207*j* and the third surface 203*j*. The eighth surface 208*j* is an inclined surface which is inclined toward a direction which includes components in the +X axial direction and the −Z axial direction. The eighth surface 208*j* is a surface which is inclined with regard to the first surface 201*j* and the third surface 203*j*. The eighth surface 208*j* is a surface which intersects at a right angle with the fifth surface 205*j* and the sixth surface 206*j*. The eighth surface 208*j* is inclined with regard to the XY flat plane and the YZ flat plane and intersects at a right angle with regard to the XZ flat plane.

The adaptor 299*j* of the cartridge 20*j* is provided with surfaces which are equivalent to the first surface 201, the third surface 203, the fourth surface 204, and the fifth surface 205 of the cartridge 20*j*. The surfaces which are equivalent to the second surface 202 and the sixth surface 206 of the cartridge 20*j* out of the surfaces of the adaptor 299*j* are openings. A space which receives the containing member 200*j* is formed in an inner portion of the adaptor 299*j*. The adaptor 299*j* has an opening in a portion of the first surface 201 and is connected to the ink supply pipe 640 by the ink supply port 280 of the containing member 200*j* being exposed via the opening.

The configuration of the cartridge 20*j* in FIG. 18 is the same as the cartridge 20 of the embodiment which is shown in FIG. 6 including the modified examples excluding the point where the containing member 200*j* and the adaptor 299*j* are able to be separated as described above. Here, in another embodiment or another modified example, a configuration where the containing member and the adaptor are able to be separated may be adopted as with the cartridge 20*j* of FIG. 18.

Here, the formation of the first cartridge side fastening section 210 has been simplified in the cartridge 20*j* of FIG. 18 in comparison with the embodiment (refer to FIG. 6), but the first cartridge side fastening section 210 may be the same shape as the embodiment. In addition, the dimensions and ratios of each section in the cartridge 20*j* of FIG. 18 may be dimensions and ratios which are the same as the embodiment even though there are portions which are different to the embodiment. In addition, the protruding section 260 is omitted in the cartridge 20*j* of FIG. 18 but the protruding section 260 may be provided in the same manner as the embodiment.

Figure 19:
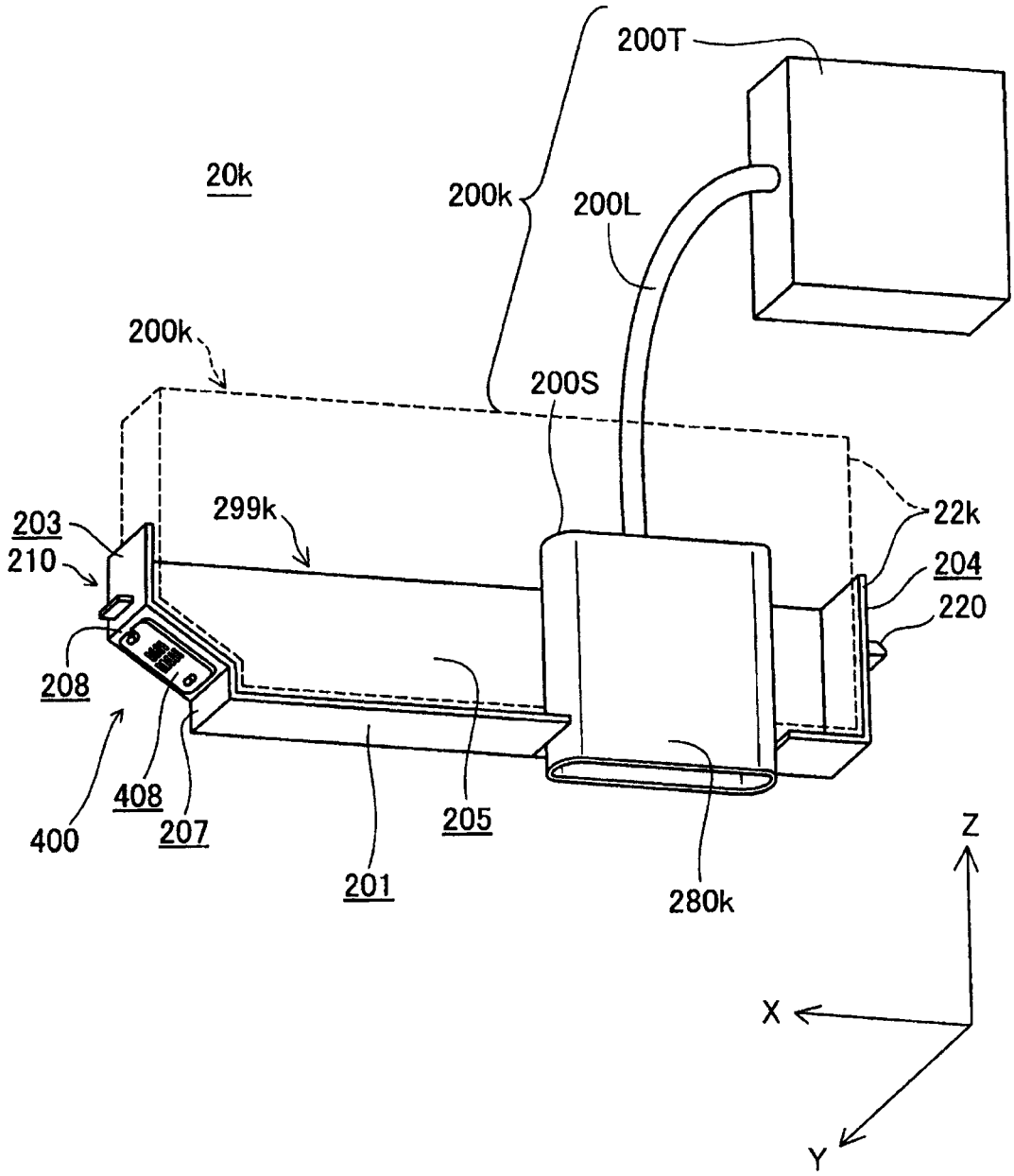
FIG. 19 is an explanatory diagram illustrating a configuration of a cartridge which uses an adapter.

FIG. 19 is a perspective diagram illustrating a configuration of a cartridge 20*k* which uses an adapter. The cartridge 20*k* is provided with an adaptor 299*k*, an external tank 200T, a tube 200L, and an auxiliary adaptor 200S. The adaptor 299*k* of the cartridge 20*k* includes modified examples and has the same configuration as the adaptor 299*j* in FIG. 18.

The external tank T200 of the cartridge 20*k* contains the printing material in an inner portion thereof. In the embodiment, the external tank 200T is disposed on the outside of the printer 50 shown in FIG. 1. The printing material of the external tank 200T is supplied to the auxiliary adaptor 200S via the tube 200L. The auxiliary adaptor 200S of the cartridge 20*k* has an ink supply port 280*k* which is equivalent to the ink supply port 280.

The external tank 200T, the auxiliary adaptor 200S and the tube 200L function as a containing member 200*k* where the ink is contained. That is, it is possible to interpret the cartridge 20*k* in FIG. 19 as having the containing member 200*k* as shown by the dotted line in the diagram. An outer shell 22*k* of the cartridge 20*k* is configured from a combination of the outer shell of the virtual containing member 200*k* and the outer shell of the adaptor 299*k*.

In this manner, it is possible for the cartridge 20*k* in FIG. 19 to take the configuration where the containing member 200*k* and the adaptor 299*j* are able to be separated in the same manner as the cartridge 20*i* of FIG. 17 and the cartridge 20*j* of FIG. 18. In a case where there is no longer any printing material in the external tank 200T, it is possible to exchange the external tank 200T with a new external tank 200T or replenish the printing material in the external tank 200T. When performing exchanging of the external tank 200T or replenishing of the printing material, it is possible to reuse the adaptor 299*k*. The cartridge 20*k* in FIG. 19 is compatible with the cartridge 20 of the embodiment shown in FIG. 6.

The configuration of the cartridge 20*k* in FIG. 19 is the same as the cartridge 20 of the embodiment which is shown in FIG. 6 including the modified examples excluding the point where the containing member 200*k* and the adaptor 299*k* are able to be separated as described above. Here, in another embodiment or another modified example, a configuration where the containing member and the adaptor are able to be separated may be adopted as in cartridge 20*k* of FIG. 19.

Modified Example Relating to Circuit Substrate 400 and Terminal Arrangement In the embodiment described above, the circuit substrate 400 is provided in the cartridge 20, but in another embodiment, the circuit substrate 400 need not be provided in the cartridge 20. That is, the cartridge side terminals may be directly formed on the eighth surface 208. In this case, the cartridge side inclined surface 408 becomes the surface of the eighth surface 208.

In addition, a portion of wiring and the storage device 420 which are formed on the circuit substrate 400 may be provided on a surface other than the surface of the eighth surface 208. For example, the wiring, the storage device 420, and the cartridge side terminals 431 to 439 may be provided on a flexible printing substrate with an area which is larger than the circuit substrate 400 and a portion of the wiring and the storage section 420 may be disposed on the fifth surface 205 which is adjacent to the eighth surface 208 so that the cartridge side terminals 431 to 439 are arranged on the eighth surface 208 by folding over the flexible printing substrate.

In addition, the arrangement of the cartridge side terminals and the device side terminals need not be in two rows and may be one row or may be three or more rows.

In addition, the formation and the arrangement of the cartridge side terminals 431 to 439 are not limited to FIG. 11A.

Figure 20A:
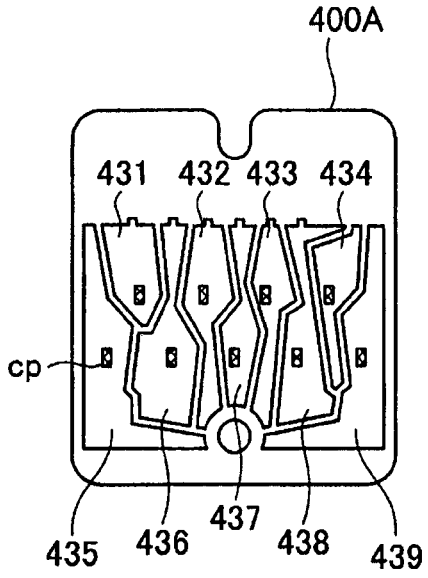
FIGS. 20A to 20C are diagrams illustrating modified examples of terminal formations.
Figure 20B:
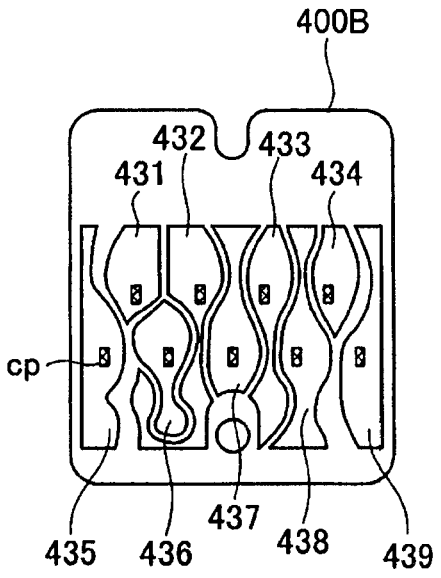
Figure 20C:
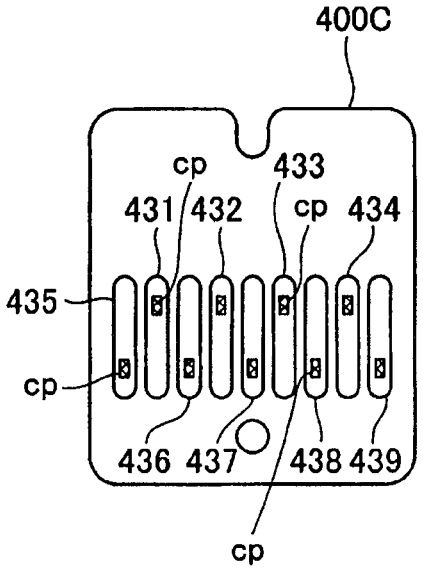

FIGS. 20A to 20C are diagrams illustrating modified examples of the formation of the cartridge side terminals.

Circuit substrate 400A, 400B, and 400C which are modified examples shown in FIG. 20 are the same as the circuit substrate 400 in FIG. 11A excluding the point where the surface formation of the cartridge side terminals 431 to 439 is different.

In the circuit substrate 400A of FIG. 20A, the surface formation of the cartridge side terminals 431 to 439 is not substantially a rectangle as with the circuit substrate 400 in FIG. 11A and are irregular polygon shapes.

In the circuit substrate 400B of FIG. 20B, the surface formation of the cartridge side terminals 431 to 439 is not substantially a rectangle as with the circuit substrate 400 in FIG. 11A and are irregular formations which is surrounded by lines and curves.

In the circuit substrate 400C of FIG. 20C, the surface formation of the cartridge side terminals 431 to 439 are straight line forms with a certain width and have the same formations. The cartridge side terminals 431 to 439 are lined up in one row in the width direction. The cartridge side terminals (the mounting detection terminals) 435 and 439 are respectively disposed on both sides of the arrangement of the lines of the cartridge side terminals 431 to 439. The cartridge side terminal (the mounting detection terminal) 431 is disposed between the cartridge side terminal (the mounting detection terminal) 435 and the cartridge side terminal (the power source terminal) 436. The cartridge side terminal 434 (the mounting detection terminal) is disposed between the cartridge side terminal 439 (the mounting detection terminal) and the cartridge side terminal (the power source terminal) 438.

In the circuit substrate 400A, 400B, and 400C which are the modified examples shown in FIGS. 20A to 20C, the disposing of the contact portion cp with the device side terminals which correspond to the cartridge side terminals 431 to 439 is the same as the embodiment of FIG. 11A. In this manner, various modifications of the surface formation of each of the terminals are possible as long as the disposing of the contact portions cp is the same.

Other Modified Examples

It is possible to omit constituent elements which have no relation to the specific aims, actions, and effects out of the constituent elements in the embodiment described above. For example, instead of the storage device 420 of the cartridge 20, another electric device may be mounted.

It is not necessary for each type of member in the embodiment described above to each be configured as independent members and a plurality of the members may be formed in an integrated manner as required. In addition, one member in the embodiment described above may be configured by combining a plurality of members.

The invention is not limited to an ink jet printer or an ink cartridge thereof and it is possible to also apply the present invention to an arbitrary liquid ejection device which ejects a liquid other than ink and a liquid containing container thereof. For example, it is possible to apply the present invention to the following various types of liquid ejection devices and liquid containing containers thereof.

Image recording devices such as a facsimile device; colorant material ejection devices which are used in manufacturing color filters which are used in image display devices such as liquid crystal displays; electrode material ejection devices which are used in forming electrodes such as in organic EL (Electro Luminescent) displays and field emission displays (FED); liquid ejection devices which eject liquids which includes a bioorganic material which is used in manufacturing biochips; sample ejection devices as precision pipettes; lubricating oil ejection devices; resin liquid ejection devices; liquid ejection devices which eject lubricating oil in a pin point manner in precision machinery such as clocks and cameras; liquid ejection devices which eject a transparent resin liquid such as an ultraviolet curing resin liquid onto a substrate in order to form a small semispherical lens (an optical lens) which is used in optical communication elements or the like; liquid ejection devices which eject an acid or alkali etching liquid in order to carry out etching of a substrate or the like; and other arbitrary liquid ejection devices which are provided with a liquid ejection head which discharges liquid droplets in small amounts.

Here, "liquid droplet" refers to a state of a liquid which is discharged from the liquid ejection device and includes liquid bodies with particle shapes and liquid bodies with teardrop shapes as well as liquid bodies which draw out a trail with a thread shape. In addition, it is sufficient if the "liquid" referred to here is a material which is able to be ejected from the liquid ejection device. For example, it is sufficient if the "liquid" is in a state where a substance is in a liquid phase, and materials in a liquid state such as materials with a liquid state where the viscosity is high or low and materials with a liquid state such as sols, gel water, other inorganic solvents, organic solvents, solutions, liquid resins, and liquid metals (metal fusion liquids) are included as "liquids". In addition, not only liquids as one state of a substance but where particles of a functional material which are formed as a solid material such as a pigment or metal particles are dissolved, dispersed, or mixed in a solvent are included as "liquids". In addition, ink as described in the embodiments described above, liquid crystals, or the like are given as representative examples of the liquid. Here, various types of liquid compositions such as typical water-based inks, oil-based inks, shell inks, and hot melt inks are included as ink.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A cartridge for use in a printing device with a printing material supply pipe, the printing material supply pipe having a filter and being formed with an elongated shape in a depth direction, the cartridge being rotated when mounted into the printing device, the cartridge comprising:

a first surface and a second surface which oppose each other;

a third surface and a fourth surface which intersect with the second surface and the first surface and which oppose each other;

a fifth surface and a sixth surface which intersect with the first surface to the fourth surface and which oppose each other, when a distance between the first surface and the second surface is height, a distance between the third surface and the fourth surface is depth, and a distance between the fifth surface and the sixth surface is width, the depth being larger than the height and the height being larger than the width; and a printing material supply port provided in the first surface, and configured and arranged to be connected to the printing material supply pipe of the printing device, the printing material supply port including a filter that contacts the filter of the printing material supply pipe when the cartridge is mounted in the printing device, the depth of the cartridge being aligned with the depth direction of the printing material supply port when the cartridge is mounted in the printing device, an effective area of the filter of the printing material supply port being the same or more and being five times or less than an effective area of the filter of the printing material supply pipe, and effective dimension of the filter of the printing material supply port in a depth direction being greater than effective dimension of the filter of the printing material supply port in a width direction.

2. The cartridge according to claim 1, wherein the effective area of the filter of the printing material supply port is two times or more and is 4.5 times or less than the effective area of the filter of the printing material supply pipe.

3. The cartridge according to claim 1, wherein the effective area of the filter of the printing material supply port is three times or more and is four times or less than the effective area of the filter of the printing material supply pipe.

4. The cartridge according to claim 1, wherein effective dimension of the filter of the printing material supply port in the depth direction is the same or more and is five times or less than effective dimension of the filter of the printing material supply pipe in the depth direction.

5. The cartridge according to claim 1, wherein effective dimension of the filter of the printing material supply port in the depth direction is 1.5 times or more and is four times or less than effective dimension of the filter of the printing material supply pipe in the depth direction.

6. The cartridge according to claim 1, wherein effective dimension of the filter of the printing material supply port in the depth direction is two times or more and is three times or less than effective dimension of the filter of the printing material supply pipe in the depth direction.

* * * * *